US008944576B2

(12) United States Patent
Sekino et al.

(10) Patent No.: US 8,944,576 B2
(45) **Date of Patent: *Feb. 3, 2015**

(54) INKJET RECORDING APPARATUS

(71) Applicant: Canon Kabushiki Kaisha, Tokyo (JP)

(72) Inventors: Takeshi Sekino, Yokohama (JP); Yasunori Saito, Yokohama (JP); Tsuyoshi Saeki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/967,637

(22) Filed: Aug. 15, 2013

(65) Prior Publication Data

US 2013/0328978 A1 Dec. 12, 2013

Related U.S. Application Data

(63) Continuation of application No. 13/217,059, filed on Aug. 24, 2011, now Pat. No. 8,534,809.

(30) Foreign Application Priority Data

Aug. 31, 2010 (JP) ..... 2010-193586

(51) Int. Cl.
*B41J 2/175* (2006.01)
*B41J 2/17* (2006.01)

(52) U.S. Cl.
CPC ..... *B41J 2/1752* (2013.01); *B41J 2/17509* (2013.01)
USPC ..... 347/85; 347/84; 347/86

(58) Field of Classification Search
USPC ..... 347/84, 85, 86
See application file for complete search history.

(56) References Cited

U.S. PATENT DOCUMENTS

2005/0035985 A1 2/2005 Taguchi

FOREIGN PATENT DOCUMENTS

JP 2007105883 A * 4/2007
JP 2007-160796 A 6/2007

* cited by examiner

*Primary Examiner* — Jannelle M Lebron
(74) *Attorney, Agent, or Firm* — Canon USA Inc IP Division

(57) ABSTRACT

An inkjet recording apparatus includes an ink passage member capable of supplying ink from an ink storage unit to a carriage, a passage connecting member capable of connecting the ink passage member to a recording head, an operating member capable of switching the passage connecting member between a connection state where the ink passage member is connected to the recording head and a disconnection state where the ink passage member is disconnected from the recording head, and an operating-member regulating member regulating the operating member. The operating-member regulating member is capable of switching the operating member between a state where switching to the disconnection state by the operating member is permitted and a state where this switching is prevented.

16 Claims, 17 Drawing Sheets

INKJET RECORDING APPARATUS

CROSS REFERENCE TO RELATED APPLICATIONS

The present application is a continuation of U.S. patent application Ser. No. 13/217,059, filed on Aug. 24, 2011, the content of which is expressly incorporated by reference herein in its entirety. This application also claims the benefit of Japanese Patent Application No. 2010-193586 filed Aug. 31, 2010, which is hereby incorporated by reference herein in its entirety.

BACKGROUND OF THE INVENTION

1. Field of the Invention

The present invention relates to an inkjet recording apparatus, and in particular, relates to an inkjet recording apparatus that discharges ink through a recording head removably mounted on a carriage to perform recording.

2. Description of the Related Art

A tube supply method is one of known ink supply methods allowing an inkjet recording apparatus to perform a high volume of printing or printing on a large sheet with a low ink-replacement frequency.

A carriage structure for the tube supply method requires a member through which a recording head is mounted on and fixed to a carriage and a joint mechanism, serving as a passage connecting member, for connecting an ink supply tube to the fixed recording head. As for the joint mechanism for connecting the recording head and the ink supply tube, a method of inserting a needle pipe connected to the ink supply tube into a sealing member provided for the recording head is often used. The sealing member is formed of rubber, for example. Accordingly, the sealing performance of the passage can be ensured.

Using multiple color inks requires a plurality of joint mechanisms for supplying the inks from different ink tanks to liquid discharge portions in the recording head. An extremely large force is therefore needed to simultaneously insert a plurality of needle pipes into the sealing members to connect the joint mechanisms to the recording head. Accordingly, an operating member for the joint mechanisms is used to easily connect the joint mechanisms to the recording head.

For this reason, the carriage structure for the tube supply method requires an operating member (recording head operating member) for fixing the recording head to the carriage and an operating member (joint mechanism operating member) for connecting the joint mechanisms to the recording head. Since these operating members are typically intended to be separately operated, a wrong operating member may be operated. If such a wrong operation is performed, the accurate connection between an ink supply system and the recording head is lost. Disadvantageously, this results in ink leakage and failure of ink discharge may occur. In addition, the joint mechanisms or components of a print cartridge may be damaged or broken.

To solve the above-described disadvantages, a configuration including the recording head operating member, the joint mechanism operating member, and a wrong operation preventing unit for these operating members. Japanese Patent Laid-Open No. 2002-234179 discloses a configuration in which the recording head cannot be replaced unless the recording head operating member and the joint mechanism operating member are operated in the correct order. For example, to remove the recording head, the joint mechanism operating member is first operated to separate the recording head from the ink supply system and the recording head operating member is operated, and the recording head is removed. If the operating members are operated in an incorrect order, the operating members interfere with each other, so that a user can recognize that the user has operated an incorrect operating member.

Inkjet recording apparatuses need replacement of a recording head in order to maintain printing quality. Some inkjet recording apparatuses are designed so as to allow a user to replace a recording head. When the user replaces the recording head, the recording head may be replaced in an incorrect procedure, alternatively, the user may perform a wrong operation at unintended timing. For example, if a recording material (print sheet) becomes jammed in the inkjet recording apparatus, the user may accidentally operate the joint mechanism operating member upon opening a cover of the apparatus. If the user performs such a wrong operation, ink stored in the ink supply system, such as an ink supply tube, may scatter and adhere to the user or a printed material. In some cases, a remarkable amount of ink leaks from the ink supply system. Unfortunately, the inkjet recording apparatus or components of the recording head may be damaged or broken.

According to a technique disclosed in Japanese Patent Laid-Open No. 2002-234179, the joint mechanism operating member can be operated separately from the other operating member. Disadvantageously, this technique cannot address such a problem that the joint mechanism operating member is accidentally operated during operation of the inkjet recording apparatus and ink leakage is caused.

SUMMARY OF THE INVENTION

The present invention provides an inkjet recording apparatus which is designed such that a passage connecting member is capable of switching between a state where the passage connecting member is connected to a recording head and a state where the passage connecting member is disconnected from the recording head and which is configured such that an operator is prevented from accidentally disconnecting the passage connecting member from the recording head while ink is being supplied.

According to an aspect of the present invention, an inkjet recording apparatus includes a carriage configured to be movable relative to a recording material, a recording head, mounted on the carriage, configured to discharge ink onto the recording material to form an image, an ink storage unit configured to be capable of storing the ink to be supplied to the recording head, an ink passage member configured to supply the ink from the ink storage unit to the carriage, a connecting member, mounted on the carriage, configured to be capable of connecting the ink passage member to the recording head, an operating member configured to switch the connecting member between a connection state where the ink passage member is connected to the recording head and a disconnection state where the ink passage member is disconnected from the recording head, and a regulating member configured to regulate an operation of the operating member.

Further features of the present invention will become apparent from the following description of exemplary embodiments with reference to the attached drawings.

DESCRIPTION OF THE EMBODIMENTS

Figure 1:
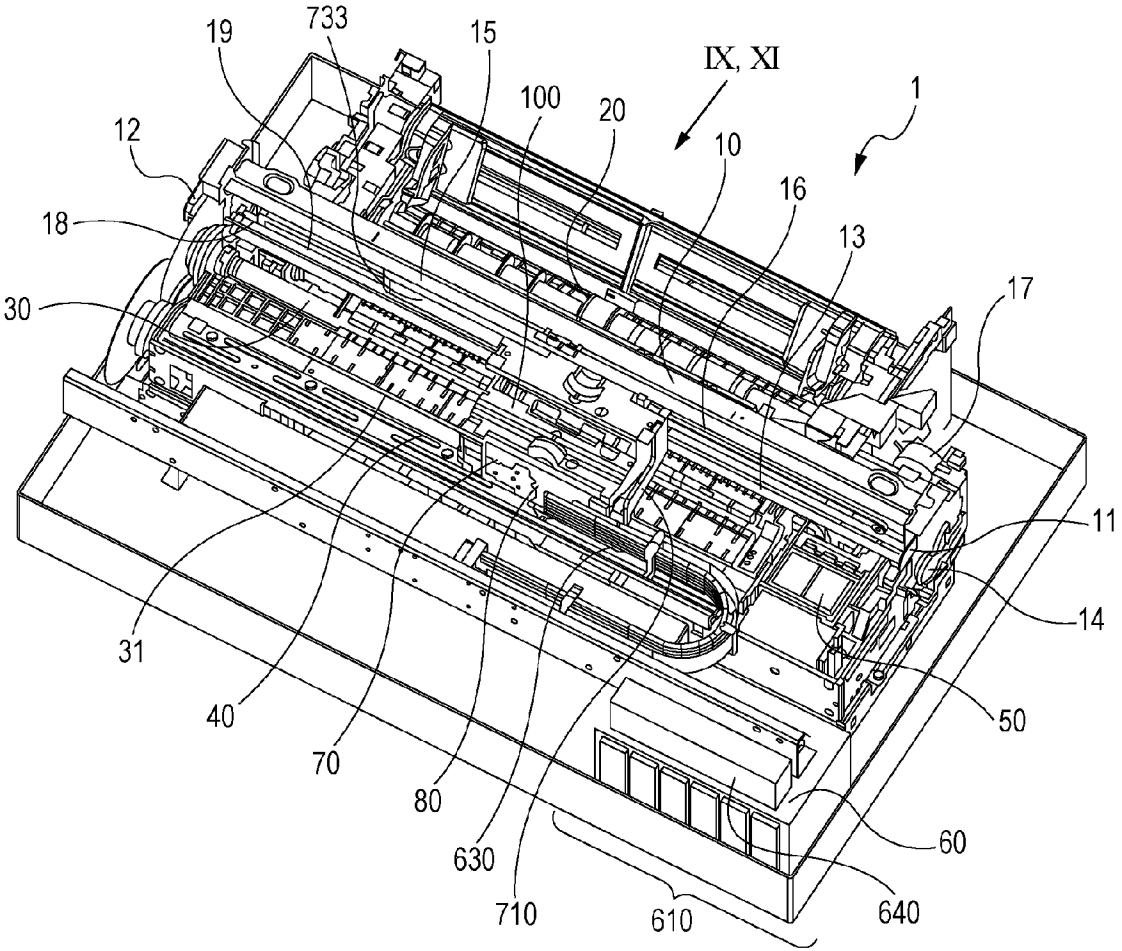
FIG. 1 is a partial perspective view of an inkjet recording apparatus according to an embodiment of the present invention.

An embodiment of the present invention will be described in detail below with reference to the drawings. In the drawings, the same reference numerals denote the same or equivalent portions. The present invention relates to an inkjet recording apparatus that discharges ink through a recording head to perform recording on a recording medium. The recording head in the present invention includes, for example, an inkjet head cartridge, an inkjet head, an inkjet cartridge, an ink cartridge, or a pen cartridge.

FIG. 1 is a general schematic perspective view of an inkjet recording apparatus according to this embodiment. The inkjet recording apparatus, indicated at 1, roughly includes a sheet feeding section 20, a sheet conveying section 30, a sheet output section 40, a carrier unit 70, a recording head recovering section (recovery unit) 50, and an ink supply unit 60. A recording head 100 is mounted on the carrier unit 70. A host device (not illustrated) transmits recording data. The data is stored by a control unit (not illustrated), disposed on a control substrate (not illustrated), included in the inkjet recording apparatus. The control unit outputs a recording start instruction, thus starting a recording operation.

After the recording operation is started, a sheet feeding operation is first performed. The sheet feeding section 20 includes, for example, an automatic sheet feeder (ASF). The ASF 20 feeds recording sheets, serving as recording media, on a one-by-one basis to the sheet conveying section 30. The fed recording sheet is gradually conveyed by the sheet conveying section (recording medium conveying unit) 30 such that the sheet is moved forward by a predetermined line feed distance without being loosened or pulled.

A carrier unit 70 is disposed above the sheet conveying section 30. The carrier unit 70 mainly includes the recording head 100 and a carriage 710, on which the recording head 100 is mounted, configured to scan (move) in a direction intersecting (typically, orthogonal to) a recording sheet conveying direction. The recording head 100 discharges ink, such that an image is formed on a recording sheet. The carriage 710 is guided and supported by a guide shaft 13 and a support rail 15. The guide shaft 13, supported by both side plates of a chassis 10, has cam members provided on both ends thereof. The support rail 15 is fixed to the top of the chassis 10. A driving force from a carriage motor 17 is transmitted through a carriage belt 16 stretched between the carriage motor 17 and an idler pulley 18 to the carriage 710, so that the carriage 710 reciprocates (scans) along the guide shaft 13. The cam members on both ends of the guide shaft 13 are rotated by a shaft lifting member 14, so that the guide shaft 13 can reciprocate (move vertically) in a direction parallel to the direction of gravity while rotating.

The recording head 100 mounted on the carriage 710 is connected through a joint needle unit 80 to ink supply tubes 630. The joint needle unit 80 functions as a passage connecting member, namely, a joint mechanism. The ink supply tubes 630, each including a flexible tube, constitute an ink passage member. The ink supply tubes 630 are arranged so as to follow the movement of the carriage 710 within the whole of a scanning range of the carriage 710 and are connected to the ink supply unit 60.

Main tanks 60 for different colors are removably attached to the ink supply unit 60. The main tanks 610 constitute an ink storage unit capable of storing ink and each include an ink storage bag (not illustrated) storing ink. The ink supply unit 60 includes an ink supply driving section 640 configured to feed air into the main tanks 610 to apply pressure to the ink storage bags for ink supply. The ink supply driving section 640 includes an air supply port through which the air is taken in from the outside, air supply tubes through which the air is conveyed to the main tanks 610, a safety valve, an air pressure relief valve, and an ink supply driving source including a motor, these components being not illustrated. The safety valve is opened when air pressure reaches a predetermined value or higher. The air pressure relief valve releases air pressure at desired timing.

The ink supply unit 60 is disposed in the vicinity of a sheet output port positioned on the front surface of the apparatus. Accordingly, the ink supply tubes 630 extending from the joint needle unit 80 mounted on the carrier unit 70 are arranged in a sheet discharging direction while being curved such that the tubes communicate with the ink supply unit 60. Accordingly, the ink supply tubes 630 can transfer the inks from the main tanks 610 to the carriage 710.

As described above, the inks stored in the main tanks 610 can be supplied from the ink supply unit 60 through the ink supply tubes 630 to the recording head 100 even while the carrier unit 70 is scanning.

The inkjet recording apparatus transmits a signal through a flexible flat circuit (FFC) 733 to the recording head 100, so that ink droplets can be discharged in accordance with recording data. A linear encoder (not illustrated) mounted on the carrier unit 70 reads a linear scale 19 attached to the chassis 10, so that ink droplets are discharged onto a recording sheet, serving as a recording material, at proper timing. When recording of one line is finished, the sheet conveying section 30 conveys (advances) the recording sheet by a necessary distance. Repeating such an operation performs the recording operation on the whole surface of the recording sheet. After that, the sheet output section 40 outputs the recording sheet and the recording operation is completed. The configuration and operation of the inkjet recording apparatus has been described in brief as described above.

Detailed Description of Components

Figure 2A:
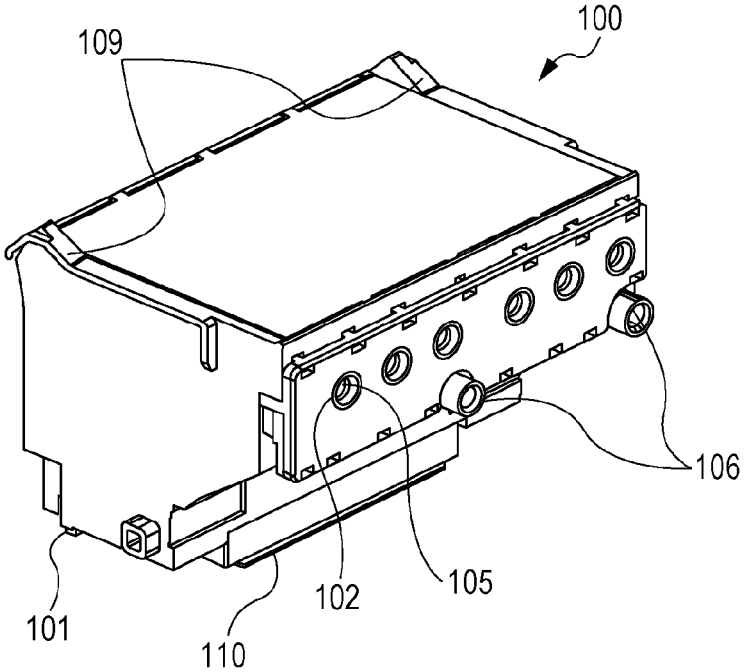
FIGS. 2A and 2B are schematic perspective views of a recording head.
Figure 2B:
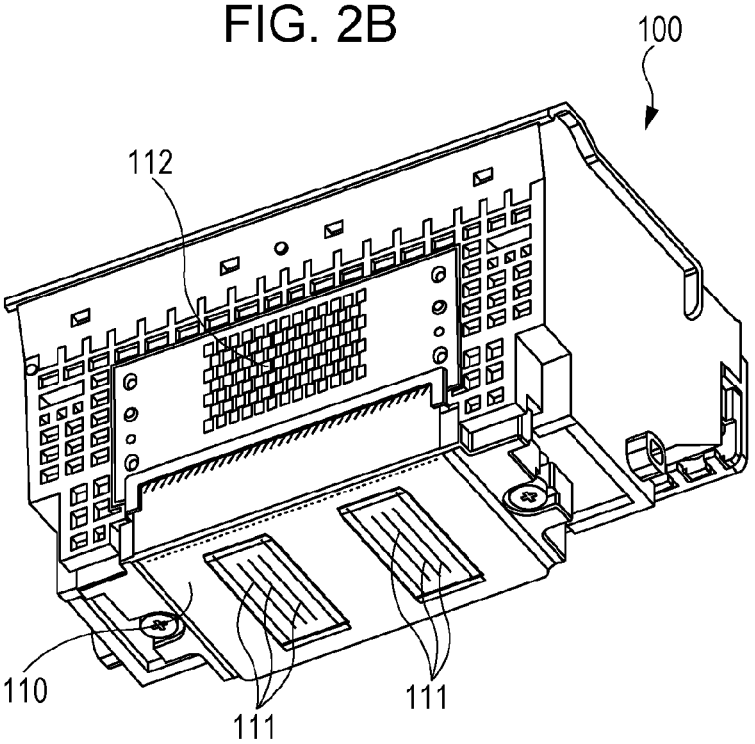
Figure 3:
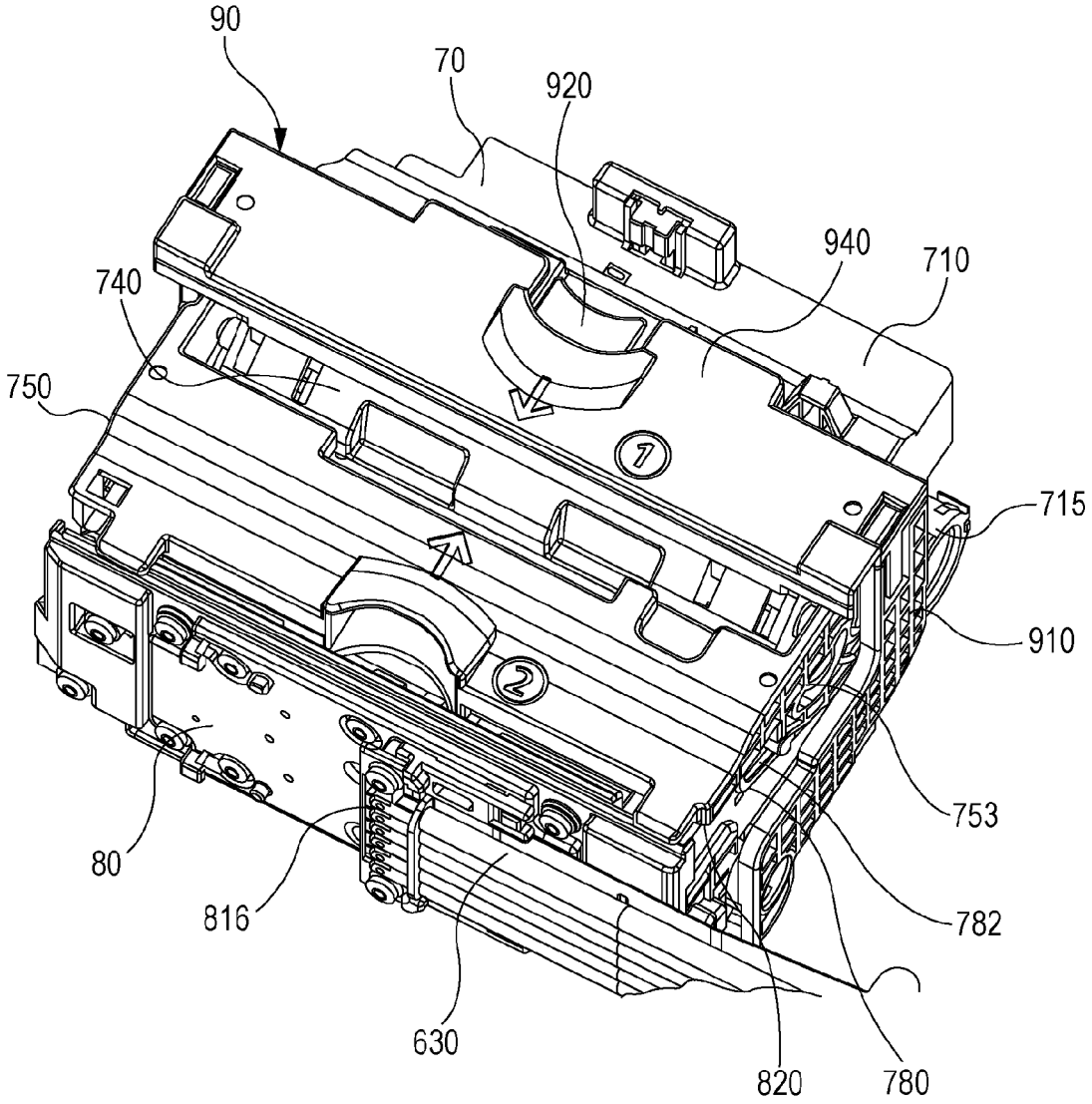
FIG. 3 is a schematic perspective view of a carrier unit.

The carrier unit 70 and the recording head 100 of the inkjet recording apparatus according to the embodiment will be described in detail below. FIGS. 2A and 2B are schematic perspective views of the recording head 100 mounted on the carriage 710. FIG. 2A is a perspective view of the recording head 100 as viewed obliquely from above. FIG. 2B is a perspective view thereof as viewed obliquely from below. FIG. 3 schematically illustrates the carrier unit 70, on which the recording head 100 is mounted, and the joint needle unit 80. FIGS. 4 to 16 are schematic diagrams illustrating states of the carrier unit 70 in the inkjet recording apparatus illustrated in FIGS. 1 and 3 and details of the carrier unit 70.

Detailed Description of Recording Head

Referring to FIGS. 2A and 2B, a plurality of ink passages (not illustrated) arranged in the recording head 100 communicate with discharge ports (nozzles) 111 arranged on a surface (facing surface) 110 facing a platen 31. The discharge ports 111, each including an actuator (energy generating unit) for ink discharge, discharge ink droplets in accordance with recording data. As regards the actuator, for example, a unit using pressure caused by film boiling generated in liquid by an electric thermal conversion member (heater) or an electromechanical conversion member (electric pressure transducer) such as a piezoelectric element.

The recording head 100 includes a plurality of (in this embodiment, six) ink supply ports 102 which receive the inks supplied from the ink supply unit 60 such that the inks flow into the inside. The inks pass through the ink passages in the recording head 100 and flow into subtanks (not illustrated) for temporarily storing the inks. Each ink supply port 102 is a cylindrical aperture integrated with the recording head 100. A cylindrical sealing member 105 made of rubber or soft resin is fitted in each cylindrical aperture. Accordingly, when needle pipes 811, which will be described later, of the joint needle unit 80 are connected to the ink supply ports 102, the contact between the outer surface of each needle pipe 811 and the inner surface of the corresponding sealing member 105 ensures ink sealing performance.

A main body of the recording head 100 has slopes 109 arranged on upper ends of right and left side walls, respectively. Each slope 109 has a predetermined angle of inclination and is configured to engage with a head fixing cam 744 of a head fixing member 740. The main body of the recording head 100 is provided with a positioning engagement member 101 disposed on the bottom surface of the main body. To mount the recording head 100 onto the carriage 710, actions of the above-described components move the recording head 100 to a predetermined mounting position on the carriage 710 in accordance with rotation of a head set lever 750, which will be described later, such that the recording head 100 is positioned. To establish electrical connection between the recording head 100 and a main body of the inkjet recording apparatus, the recording head 100 is provided with an electric substrate (head substrate) 112 having an exposed conducting portion which is not coated with resist.

Detailed Description of Carrier Unit

Figure 15:
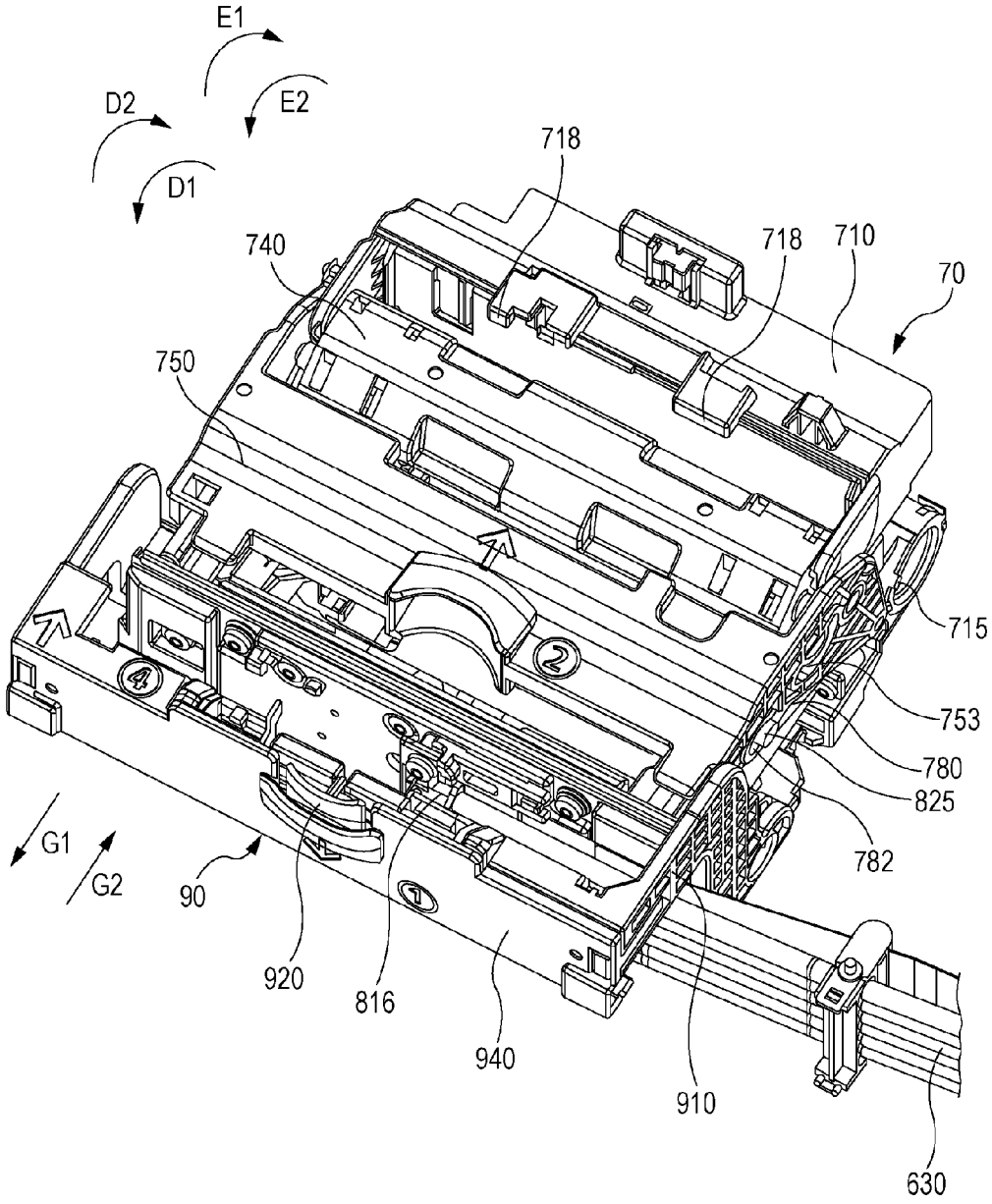
FIG. 15 is a perspective view illustrating a state where the lever for the joint needle unit is opened.
Figure 16:
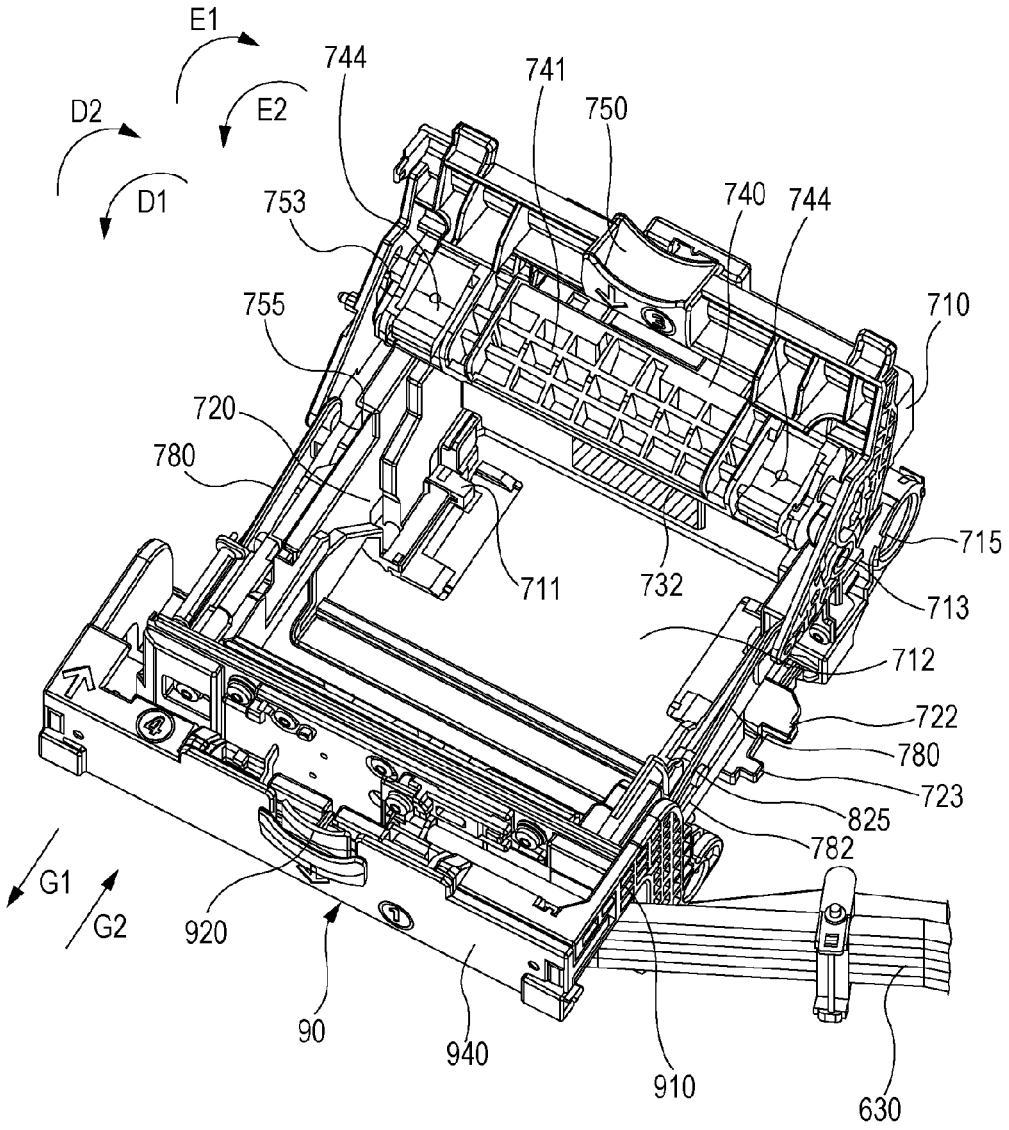
FIG. 16 is a schematic perspective view illustrating a state where a head set lever is opened.

The carrier unit 70 will be described with reference to FIGS. 3 to 12 and FIGS. 14 to 16. FIG. 3 is a schematic perspective view of the carrier unit 70 in a state where the recording head 100 is mounted on the carriage 710 and the head set lever 750 and a needle attachment/detachment lever 90 are closed. FIG. 16 illustrates the carriage 710 in a state where the head set lever 750 and the head fixing member 740 are opened and the recording head 100 is removed from the carriage 710.

Referring to FIG. 16, the carriage 710 includes a recording-head receiving portion 712 shaped so as to receive the recording head 100 in the carriage 710 such that the recording head 100 can be positioned. The carriage 710 further includes a carriage cover 720 configured to guide the recording head 100 when the recording head 100 is mounted and the head fixing member 740 configured to press and fix the recording head 100 in a predetermined position in the carriage 710.

The recording-head receiving portion 712 of the carriage 710 has a positioning protrusion 711 configured to position the recording head 100 in the mounting position. The recording head 100 includes the positioning engagement member 101 configured to engage with the positioning protrusion 711. Accordingly, the recording head 100 can be accurately and reliably mounted in the predetermined mounting position in the recording-head receiving portion 712 of the carriage 710.

Referring to FIG. 16, the carriage 710, on which the recording head 100 is to be mounted, is provided with a pressure contact connector 732 made of metal plated. The pressure contact connector 732 is brought into pressure contact with the exposed conducting portion of the recording head 100 as the metal is elastically deformed, so that the pressure contact connector 732 is electrically connected to the exposed conducting portion of the recording head 100. The pressure contact connector 732 is soldered to a substrate (carriage substrate) 730 (refer to FIGS. 7 and 8) included in the carriage 710. The carriage substrate 730 is electrically connected to a circuit board (control substrate) in the main body of the apparatus through the FFC 733 illustrated in FIG. 1.

On the carriage substrate 730, the linear encoder (not illustrated) configured to detect the position of the carriage 710 is mounted. The linear encoder reads a line number of the linear scale 19 attached to the chassis 10 to detect the position of the carrier unit 70. A signal output from the linear scale 19 is transmitted through the FFC 733 to the control substrate and is then processed in the control substrate.

Accordingly, even while the carriage 710 is moving, the position of the carriage 710 can be accurately obtained. Moreover, if a change of signal from the linear encoder is not observed while the carriage motor 17 is driven for a predetermined period, the carriage 710 stops at any position. The last detected position can be therefore detected as a stopping position.

In the inkjet recording apparatus according to the present embodiment, to initialize the scanning position of the carriage 710, the carriage 710 is allowed to scan toward the right inner side surface of the chassis 10. A position where the carriage 710 stops because it abuts against the right inner side surface is determined as a scanning reference position. The carriage 710 has an abutment reference face 715 configured to abut against fixed part on the right (reference side) inner side surface of the chassis 10.

Figure 14:
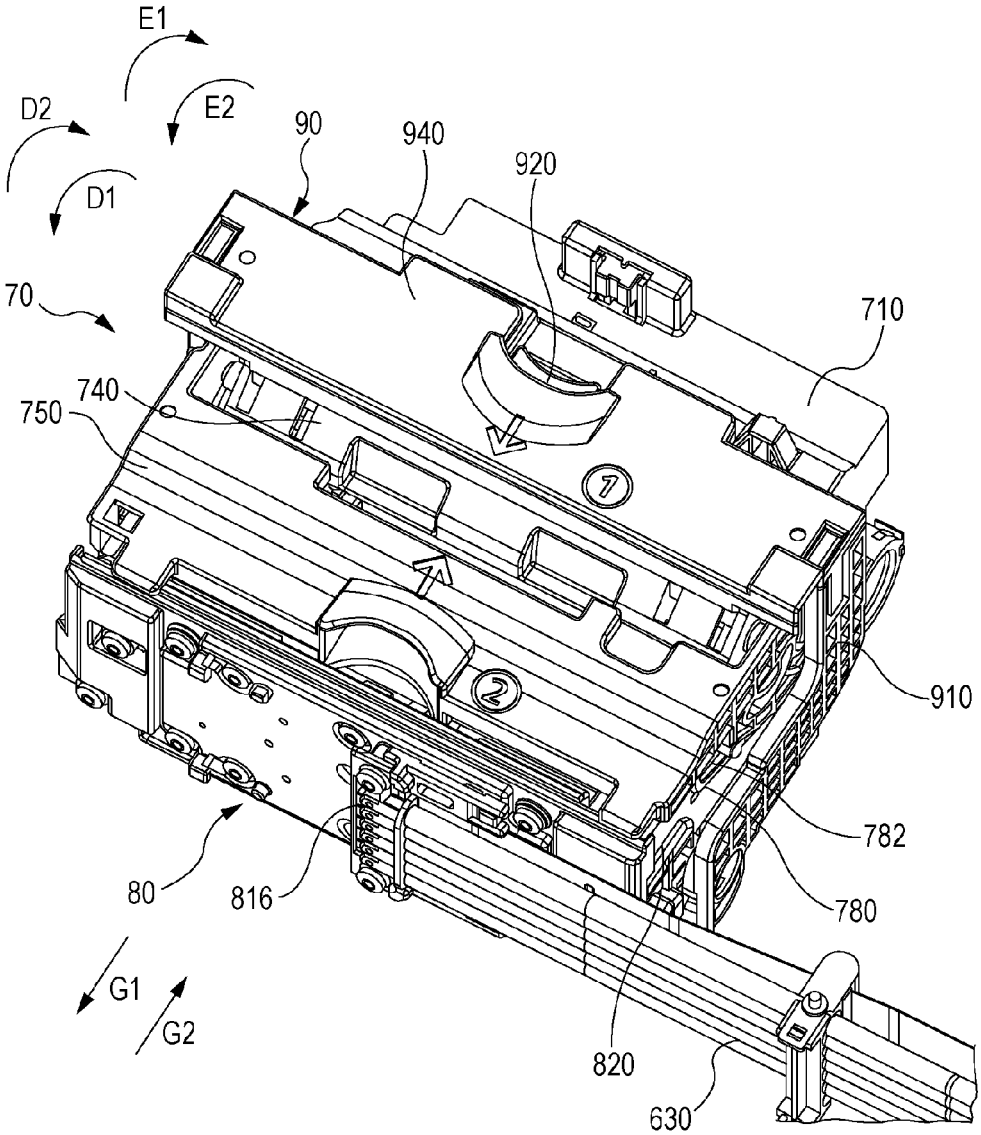
FIG. 14 is a schematic perspective view illustrating a state where the lever engagement member is pulled down.

The carriage 710 is provided with the head set lever 750 functioning as an operating member to which an operator applies a force to swing the head fixing member 740. The head set lever 750 is rotatable about a lever rotation shaft 713 extending in parallel to a moving direction of the carriage 710. The head fixing member 740 is opened or closed in accordance with rotation of the head set lever 750. Referring to FIGS. 14 to 16, the head set lever 750 is rotated about the lever rotation shaft 713 in the direction E2, so that the recording head 100 is guided to the predetermined mounting position on the carriage 710 and is pressed and fixed to the carriage 710.

The head set lever 750 is connected through link members 780 to the joint needle unit 80. One end of each link member 780 has a circular connection hole (not illustrated) configured to engage with a link connection portion 755 of the head set lever 750. The other end thereof has an elongated connection hole 782 configured to engage with a link connection portion 825 of the joint needle unit 80. The elongated connection hole 782 functions as a dead zone for preventing the head set lever 750 from being swung through the link members 780 by translation of the joint needle unit 80 during a needle attachment or detachment operation, which will be described later. Each link member 780 operates about the link connection portion 755 in accordance with rotation of the head set lever 750. The operation of the link member 780 brings the elongated connection hole 782 into contact with the link connection portion 825 of the joint needle unit 80, so that the joint needle unit 80 accordingly moves. In other words, the link connection portion 825 is operatively connected to the needle attachment/detachment lever 90 to translate the joint needle unit 80.

On both sides of the carriage cover 720, joint needle guides (not illustrated), including a pair of guide members, are arranged. The joint needle guides hold the joint needle unit 80 and guide the joint needle unit 80 slidably in the directions G1 and G2. Specifically, the joint needle unit 80 is regulated and guided by the joint needle guides so as to translate. Accordingly, the joint needle unit 80 can translate in conjunction with swing of the head set lever 750.

In the vicinity of each joint needle guide of the carriage cover 720, a pushing guide member 722 and a drawing guide member 723 are arranged. The pushing guide member 722 slides on a corresponding outer circumferential cam face 912 of the needle attachment/detachment lever 90 provided for the joint needle unit 80. The drawing guide member 723 guides a corresponding inner circumferential cam face 913 of the needle attachment/detachment lever 90.

Description of Joint Needle Unit

Figure 4:
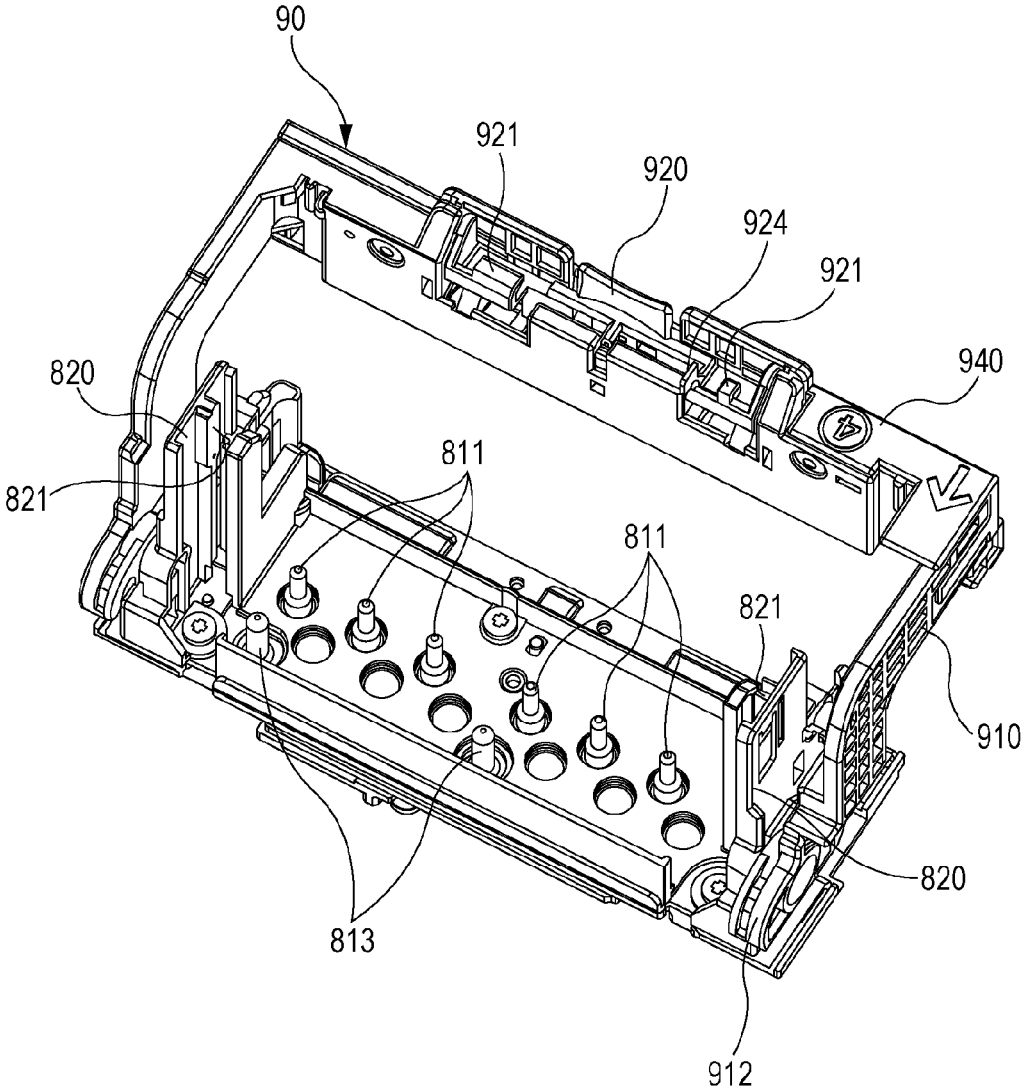
FIG. 4 is a partial perspective view of a joint needle unit.

FIG. 4 is a schematic perspective view of the joint needle unit 80. The joint needle unit 80 is mounted on the carrier unit 70 (carriage 710) and is removably attached to the recording head 100. The joint needle unit 80 functions as a passage connecting member or joint mechanism allowing the ink supply tubes 630 to communicate with the passages in the recording head 100.

The joint needle unit 80 is provided with a plurality of (in the present invention, six) hollow needle pipes 811 arranged so as to correspond to the sealing members 105 in the recording head 100, as illustrated in FIG. 4. The needle pipes 811 are inserted into the ink supply ports 102 of the recording head 100, so that the ink supply tubes 630 are connected to the passages in the recording head 100 such that the ink supply tubes 630 can supply the inks to the recording head 100.

Referring to FIG. 3, tube connection members 816 are arranged on another surface of the joint needle unit 80. The tube connection members 816 are connected to the ink supply tubes 630 connected to the ink supply unit 60. The tube connection members 816 and the needle pipes 811 communicate with ink passages (not illustrated) arranged in a main body of the joint needle unit 80.

The joint needle unit 80 is provided with a plurality of positioning pins 813 corresponding to a plurality of (in the present embodiment, two) positioning cylinders 106 arranged on the surface of the recording head 100 where the ink supply ports 102 are arranged. When the needle pipes 811 are inserted into the ink supply ports 102, the joint needle unit 80 is positioned by the positioning cylinders 106. The joint needle unit 80 is movable in the directions G1 and G2 along the joint needle guides (not illustrated) provided for the carriage cover 720. Accordingly, the joint needle unit 80 includes guiding side plates 820 configured to engage with the joint needle guides. Each guiding side plate 820 includes a sliding portion 821 projecting inward. The guiding side plate 820 further includes the link connection portion 825 rotatably supported by the elongated connection hole 782 of the corresponding link member 780.

Referring to FIG. 4, the needle attachment/detachment lever 90 with which the operator attaches or detaches the joint needle unit 80 is journaled rotatably about a lever rotation shaft (not illustrated) by the guiding side plates 820. When the needle attachment/detachment lever 90 is operated and rotated to a predetermined position, the needle pipes 811 of the joint needle unit 80 are inserted to or removed from the ink supply ports 102 of the recording head 100. Thus, the ink passages from the ink supply unit 60 to the recording head 100 are established or broken. Specifically, the joint needle unit 80 translates to switch between a connection state where the ink supply tubes 630 are connected to the recording head 100 and a disconnection state where the ink supply tubes 630 are disconnected from the recording head 100.

Detailed Description of Needle Attachment/Detachment Lever

The needle attachment/detachment lever 90, serving as an operating member configured to attach or detach the joint needle unit 80 to or from the recording head 100 will be described. The needle attachment/detachment lever 90 is rotatably mounted on the joint needle unit 80. The joint needle unit 80 translates in conjunction with rotation of the needle attachment/detachment lever 90, so that the connection state or the disconnection state is selectively achieved. To accomplish the above-described function, the needle attachment/detachment lever 90 is rotatable between a first rotation position in which the connection state is provided and a second rotation position in which the disconnection state, where the joint needle unit 80 is separated from the recording head 100, is provided.

Figure 5:
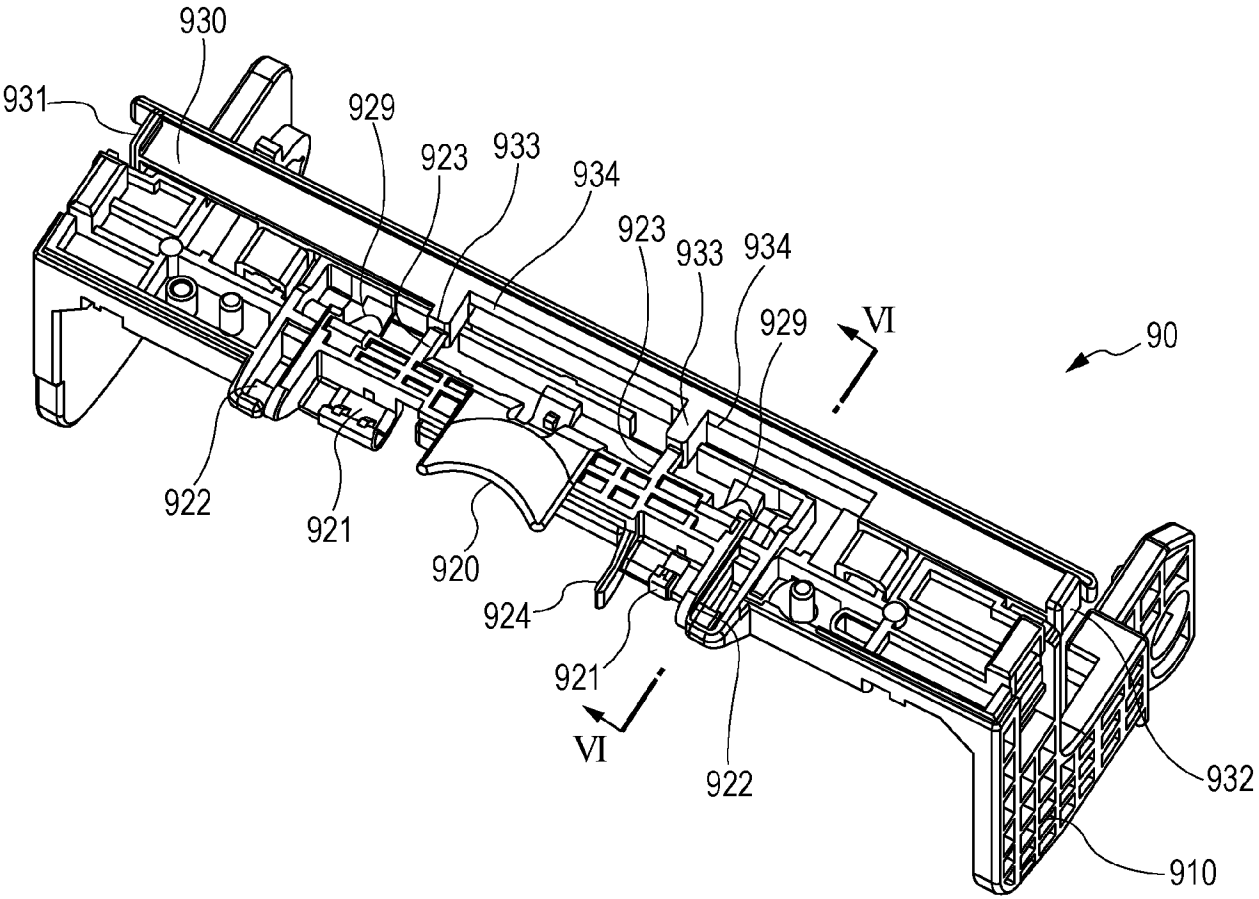
FIG. 5 is a schematic perspective view of a lever of the joint needle unit.
Figure 6:
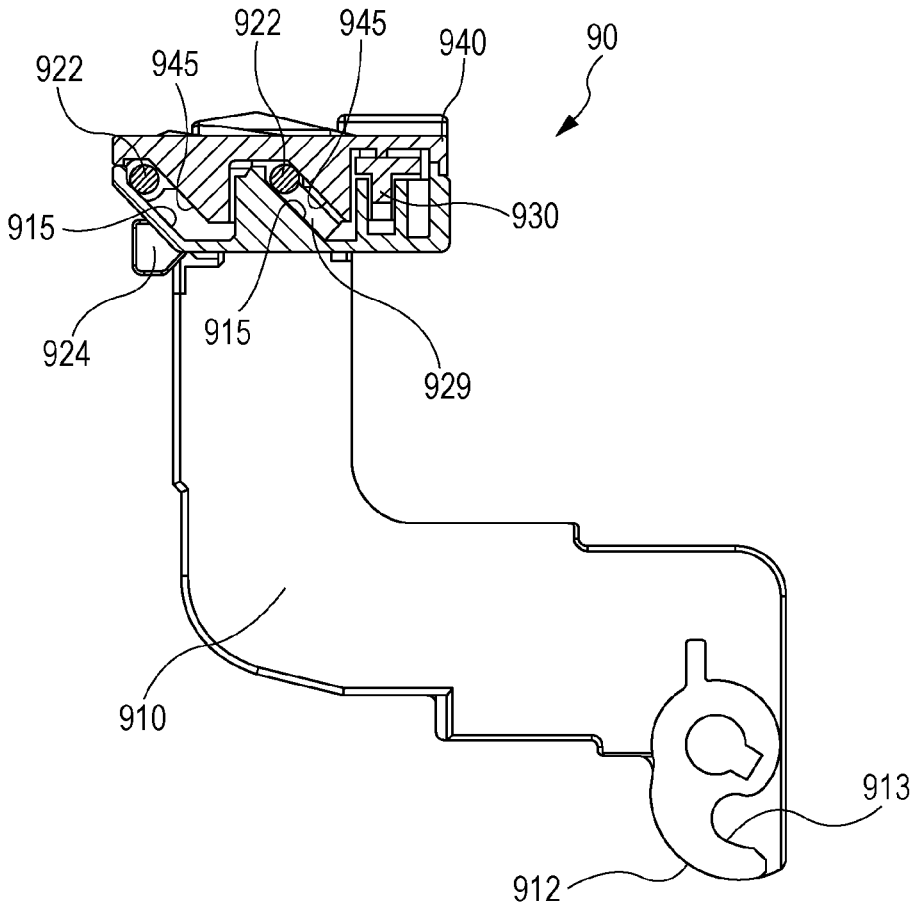
FIG. 6 is a schematic cross-sectional view of the lever taken along the line VI-VI in FIG. 5.

FIG. 5 is a schematic perspective view of the needle attachment/detachment lever 90. For convenience of explanation, an upper cover 940 included in the needle attachment/detachment lever 90 is omitted. FIG. 6 is a schematic cross-sectional view of the needle attachment/detachment lever 90 taken along the line VI-VI of FIG. 5.

Referring to FIGS. 5 and 6, a lever engagement member 920 is incorporated in a main body (hereinafter, referred to as the "lever main body") 910 of the needle attachment/detachment lever 90 while being urged by compression springs 929 such that the lever engagement member 920 is movable forward and backward. The lever engagement member 920 has guide bosses 922 arranged on both ends thereof. Each guide boss 922 is guided along an engagement-member guide face 915 of the lever main body 910 and an engagement-member guide face 945 of the upper cover 940. Accordingly, the lever engagement member 920 is urged obliquely upward along guide members each including the engagement-member guide faces 915 and 945 at all times. At this time, the needle attachment/detachment lever 90 is placed in the first rotation position.

The lever engagement member 920 includes engagement portions 921. While the needle attachment/detachment lever 90 is closed (in the first rotation position), the engagement portions 921 engage with hooks 718, which will be described later, provided for the carriage 710 to prevent the lever engagement member 920 from being released. The lever engagement member 920 further includes a shielding portion 924 configured to enter a sensor portion of a photo-interrupter 734 to shield the sensor portion when the engagement portions 921 engage with the hooks 718.

Figure 7:
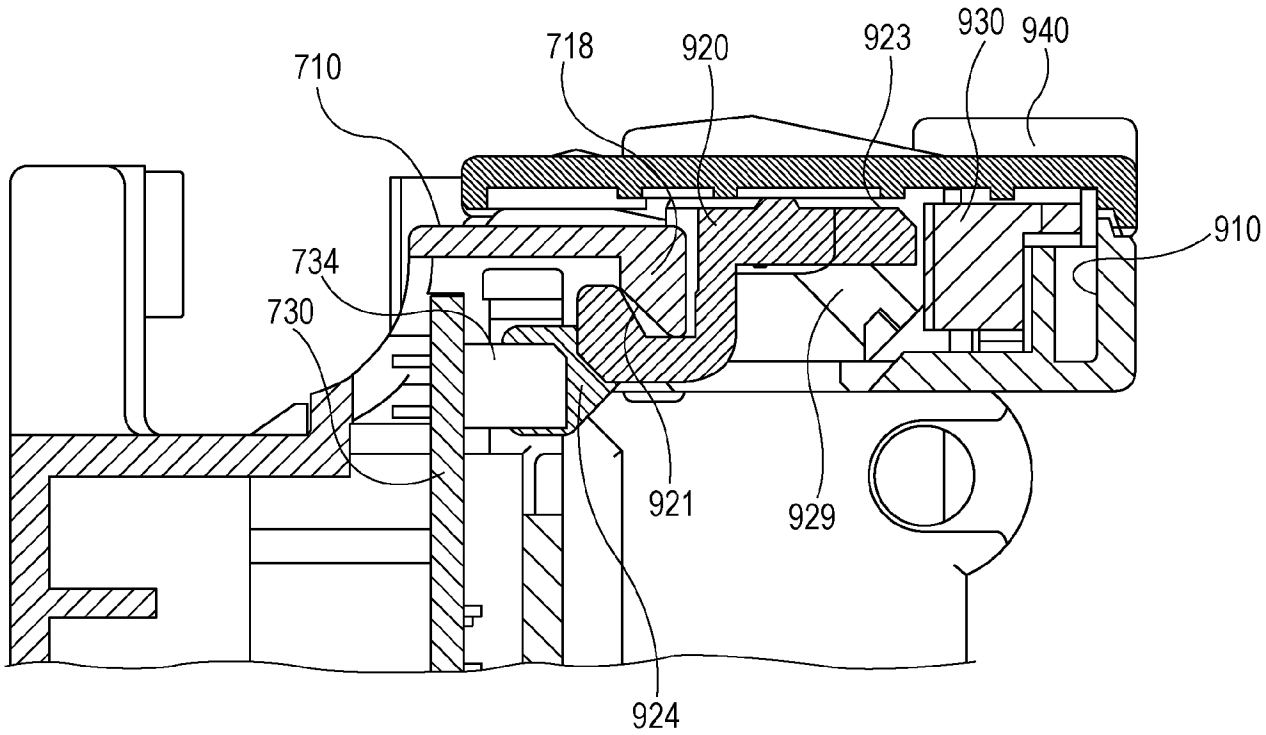
FIG. 7 is a cross-sectional view illustrating a state where a lever engagement member is engaged with a hook of a carriage.

FIG. 7 is a schematic cross-sectional view illustrating a state where the engagement portion 921 of the lever engagement member 920 engages with the hook 718 of the carriage 710 while the needle attachment/detachment lever 90 is closed. The carriage substrate 730 is provided with the photo-interrupter 734, serving as an engagement sensor for the lever engagement member 920, as illustrated in FIG. 7. While the needle attachment/detachment lever 90 is closed and the lever engagement member 920 engages with the carriage 710, the shielding portion 924 of the lever engagement member 920 exists in the sensor portion of the photo-interrupter 734. Accordingly, when the lever engagement member 920 engages with the carriage 710, the photo-interrupter 734 simultaneously detects the lever engagement member 920 placed in an engagement position. Thus, a closed posture of the needle attachment/detachment lever 90 is detected.

Figure 8:
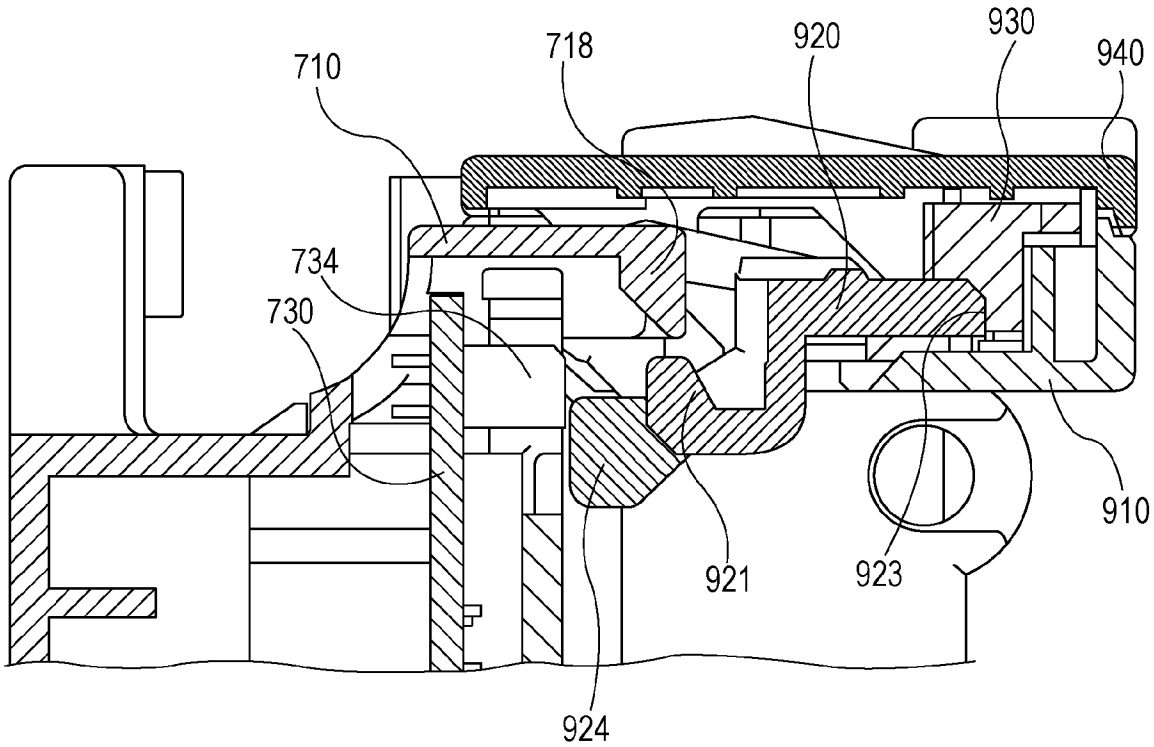
FIG. 8 is a cross-sectional view illustrating a state where the lever engagement member is disengaged from the hook of the carriage.

FIG. 8 is a schematic cross-sectional view illustrating a state where the lever engagement member 920 is placed in a withdrawal position in the needle attachment/detachment lever 90 after being guided obliquely downward along the engagement-member guide faces 915 against an urging force of the compression springs 929. The engagement portions 921 of the lever engagement member 920 are disengaged from the hooks 718 of the carriage 710. Since the shielding portion 924 of the lever engagement member 920 has been withdrawn from the sensor portion of the photo-interrupter 734, the disengagement between the lever engagement member 920 and the carriage 710 is detected.

A slider member 930 configured to selectively regulate withdrawal of the lever engagement member 920. Referring to FIGS. 5 to 8, 10, and 12, the slider member 930 configured to regulate the withdrawal of the lever engagement member 920 is disposed on the rear side of the lever engagement member 920, namely, on the side where the lever engagement member 920 is withdrawn. The slider member 930 has an elongated body extending in the moving direction (main scanning direction) of the carriage 710. Ends 931 and 932 of the slider member 930 are configured to abut against a reference-side switching member 11 and a non-reference-side switching member 12 provided for the side plates of the chassis 10, respectively. The slider member 930 is slidable in the main scanning direction. In other words, the slider member 930 is movable relative to the carriage 710 in the moving direction of the carriage between a first position and a second position which will be described later.

Figure 10:
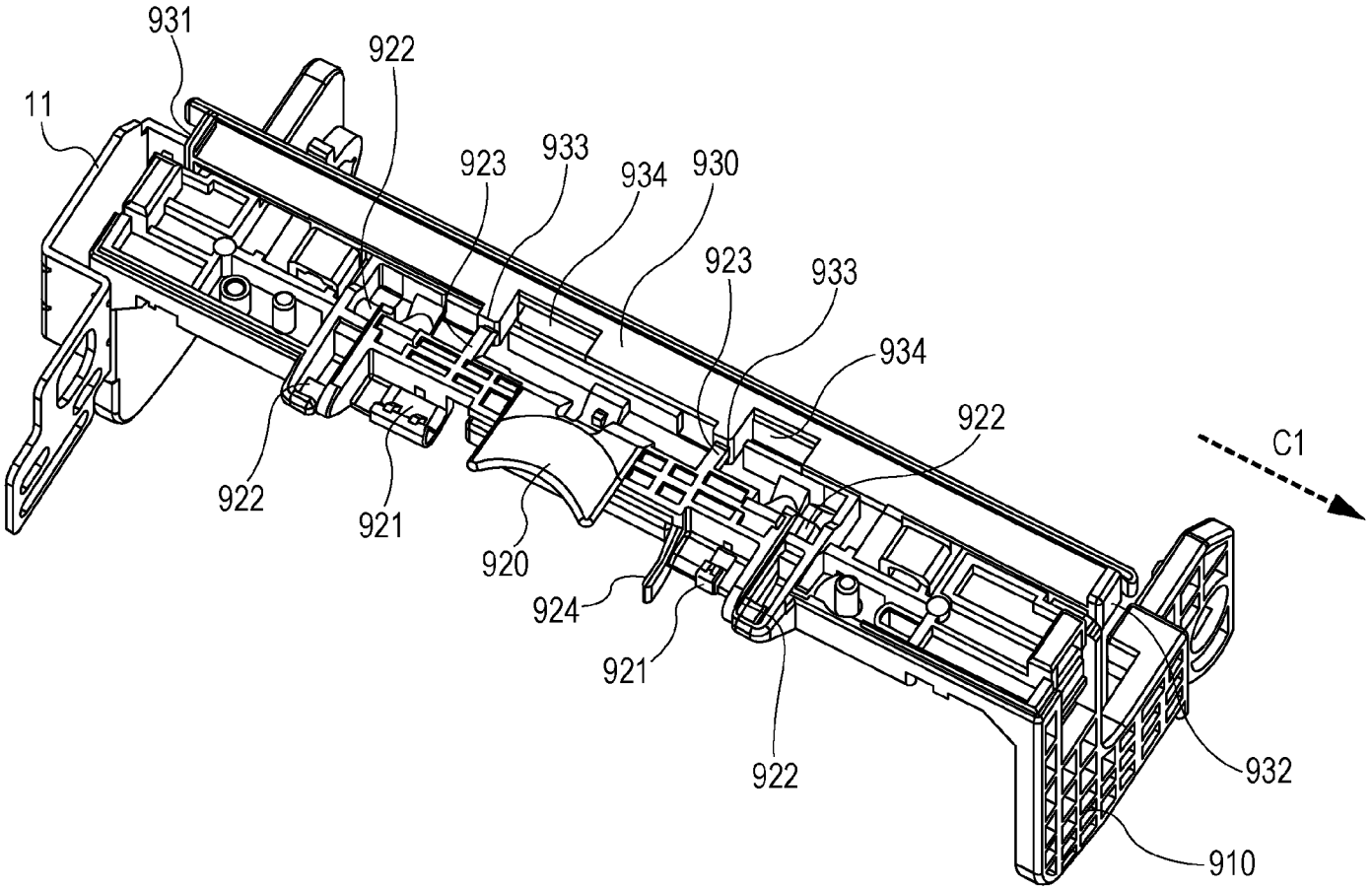
FIG. 10 is a perspective view of the lever of the joint needle unit in a state of FIG. 9.
Figure 12:
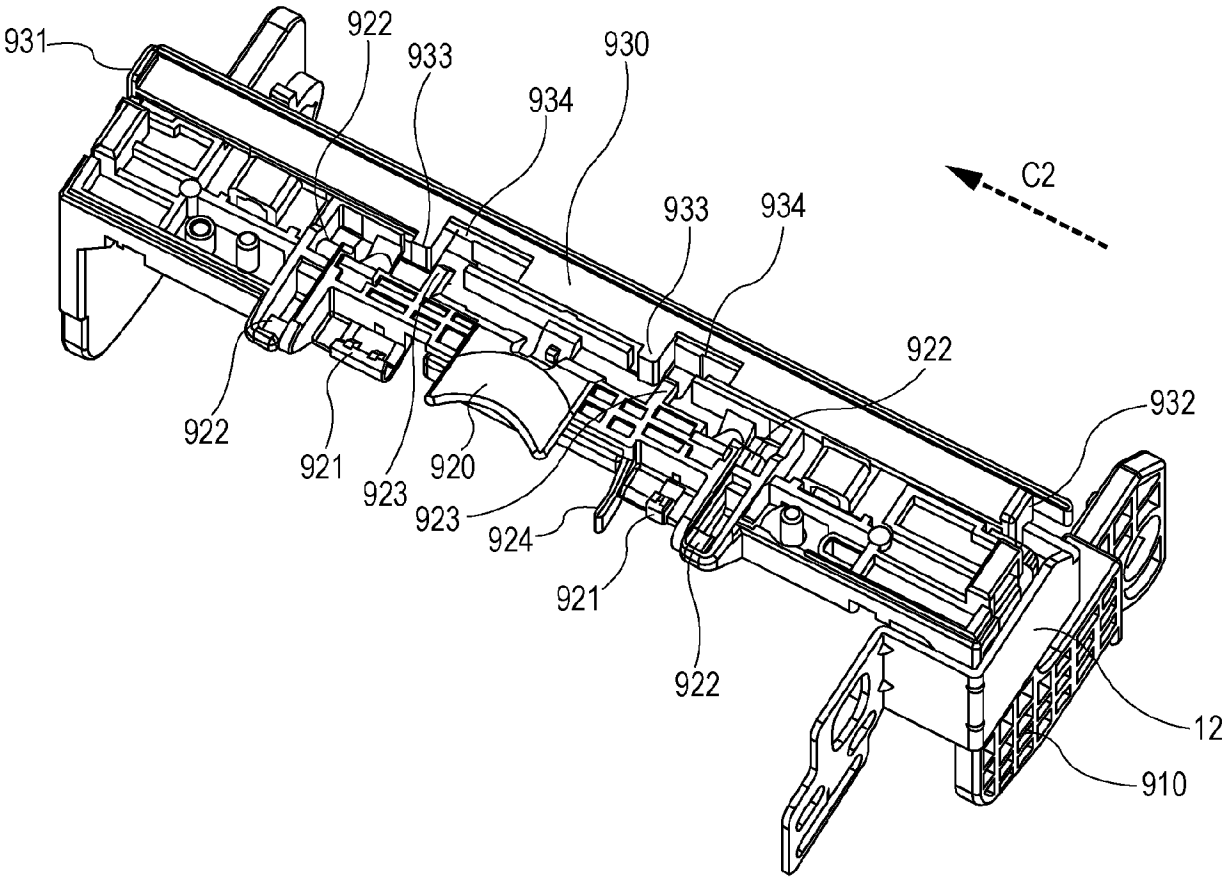
FIG. 12 is a perspective view of the lever of the joint needle unit in a state of FIG. 11.

The slider member 930 has protrusions (slider abutment portions) 933 protruding from the elongated body. The protrusions 933 prevent the lever engagement member 920 from moving from the engagement position, where the lever engagement member 920 engages with the hooks 718 of the carriage 710, to the disengagement position. While the slider member 930 is in the first position, engagement-member rear end portions 923 of the lever engagement member 920 which face the slider member 930 are positioned such that the portions 923 face the protrusions 933. While the slider member 930 is in the second position, the engagement-member rear end portions 923 of the lever engagement member 920 are positioned such that the portions 923 face withdrawal permitting portions (movement permitting portions) 934 of the slider member 930. The withdrawal permitting portions 934 may have any shape so long as the lever engagement member 920 can be withdrawn backward. Parts of the slider member 930 may be used as the withdrawal permitting portions 934. Notches may be provided as illustrated in FIGS. 10 and 12. The entire body, excluding the protrusions 933, of the slider member 930 may serve as the withdrawal permitting portion 934. Alternatively, only parts of the slider member 930 may be used as the withdrawal permitting portions 934.

The slider member 930 is positioned in the sheet conveying direction while being guided by the lever main body 910 and is urged against the lever main body 910 by a compression spring (not illustrated) disposed between the slider member 930 and the lever main body 910. In the vertical direction, lower part of the slider member 930 is positioned by the lever main body 910 and upper part thereof is positioned by the upper cover 940 of the needle attachment/detachment lever 90. The slider member 930, serving as a regulating member, is configured to be movable relative to the lever main body 910 and the lever engagement member 920 in the main scanning direction within a region where the lever engagement member 920 is withdrawn in the needle attachment/detachment lever 90.

Figure 9:
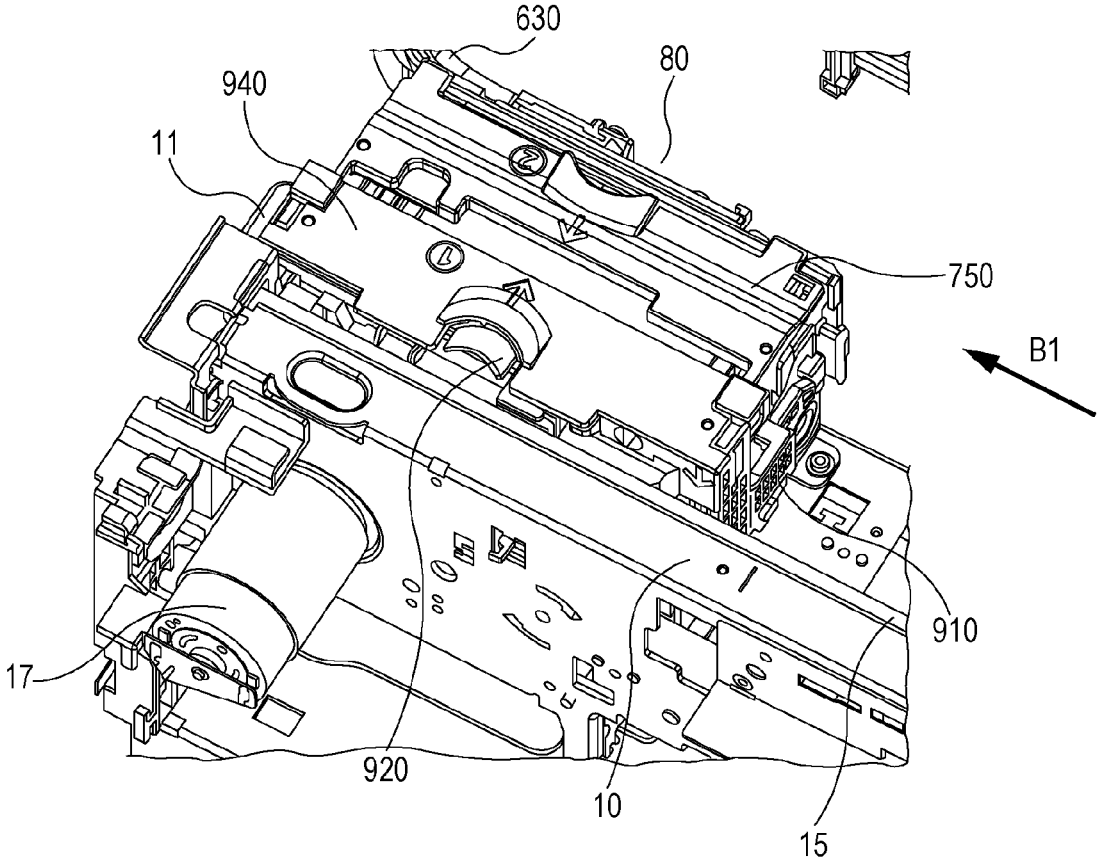
FIG. 9 is a schematic perspective view of the carrier unit in a reference abutment position.

FIG. 9 is a schematic perspective view illustrating a state where the carrier unit 70 (carriage 710) abuts against the right (reference side) inner side surface of the chassis 10, as viewed in the direction IX in FIG. 1. FIG. 10 is a partial perspective view of the lever engagement member 920 and the slider member 930 in the needle attachment/detachment lever 90 in the state of FIG. 9. As illustrated in FIGS. 9 and 10, when the carriage 710 abuts against the chassis 10 on the reference side (in the reference abutment position), the right end 931 of the slider member 930 comes into contact with the reference-side switching member 11 disposed on the right side of the chassis such that the slider member 930 is in the first position. While the slider member 930 is in the first position, the protrusions 933 are positioned so as to face the engagement-member rear end portions 923 of the lever engagement member 920, respectively. If the operator operates the lever engagement member 920 in such a state, therefore, the engagement-member rear end portions 923 are in contact with the protrusions 933, so that the lever engagement member 920 cannot be withdrawn. In this state, the lever engagement member 920 engages with the hooks 718 of the carriage 710 and the needle attachment/detachment lever 90 is held in the first rotation position. This prevents switching to the disconnection state by the needle attachment/detachment lever 90.

Figure 11:
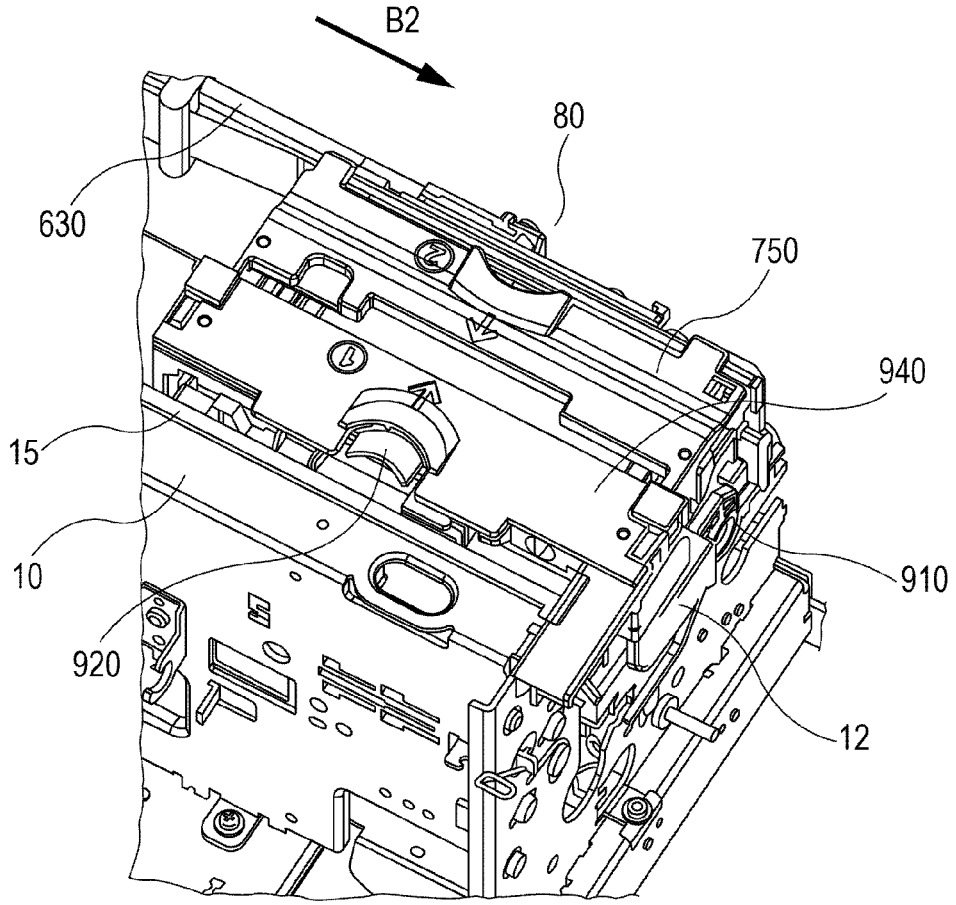
FIG. 11 is a schematic perspective view of the carrier unit in a non-reference abutment position.

FIG. 11 is a schematic perspective view illustrating a state where the carrier unit 70 (carriage 710) abuts against the left (non-reference side) inner side surface of the chassis 10, as viewed in the direction XI in FIG. 1. FIG. 12 is a partial perspective view of the lever engagement member 920 and the slider member 930, which serve as inner components of the needle attachment/detachment lever 90, and the non-reference-side switching member 12 in the state of FIG. 11. As illustrated in FIGS. 11 and 12, when the carriage 710 abuts against the chassis 10 on the non-reference side (in the non-reference abutment position), the left end 932 of the slider member 930 comes into contact with the non-reference-side switching member 12 disposed on the left side of the chassis 10 such that the slider member 930 is in the second position. While the slider member 930 is in the second position, the withdrawal permitting portions (movement permitting portions) 934 are positioned so as to face the rear end portions 923 of the lever engagement member 920. When the operator pulls down the lever engagement member 920 against the urging force of the compression springs 929, the lever engagement member 920 can be withdrawn obliquely downward into the needle attachment/detachment lever 90 while being guided along the engagement-member guide faces 915. Consequently, switching to the disconnection state by the needle attachment/detachment lever 90 is permitted. Such a state that the lever engagement member 920 is withdrawn by the operator is illustrated in FIGS. 8 and 14.

In the present embodiment, when the slider member 930 is slid in the main scanning direction and comes into contact with the reference-side switching member 11, provided for the chassis 10, near the recovery unit, the slider member 930 is in the first position as illustrated in FIG. 10. The reason is that when an operation of determining the position of the carriage 710 in the main scanning direction has to be performed during, for example, cleaning, the carriage 710 is allowed to abut against the chassis 10 near the recovery unit in order to typically eliminate the waste of time.

As described above, the slider member 930 can be switched between a state where the lever engagement member 920 can be withdrawn and a state where the lever engagement member 920 cannot be withdrawn. Accordingly, the slider member 930 can switch the lever engagement member 920 between a state where switching to the disconnection state by the needle attachment/detachment lever 90 is permitted and a state where this switching is prevented. As will be described later, while the inks are supplied from the ink passage member to the recording head 100, the needle attachment/detachment lever 90 is kept in a state where switching to the disconnection state is prevented. As described above, the needle attachment/detachment lever 90 and the lever engagement member 920 function as an operating member for switching between the connection state and the disconnection state and the slider member 930 functions as an operating-member regulating member configured to regulate movement of the lever engagement member 920 and operating the needle attachment/detachment lever 90.

Procedure of Head Replacement

Head Replacement Preprocessing

An operation of removing the recording head 100 from the carriage 710 for replacement will be described below. An operation of mounting a recording head onto the carriage 710, on which any recording head is not mounted, is generally similar to the above operation.

Figure 13:
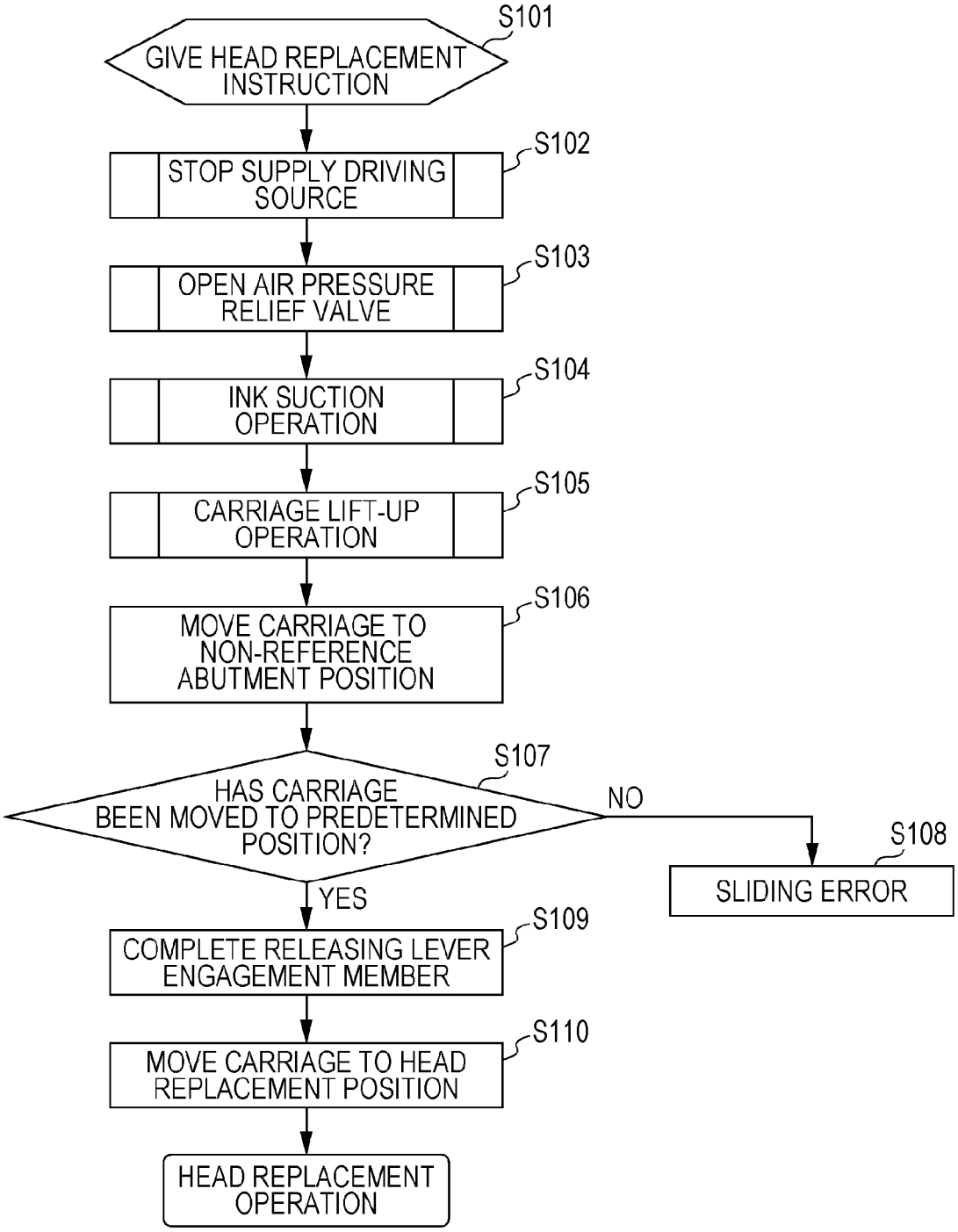
FIG. 13 is a flowchart of replacement pre-processing in a recording head replacement mode.

FIG. 13 is a general flowchart of head replacement preprocessing in a recording head replacement mode. The operator performs a predetermined operation to shift the inkjet recording apparatus to the recording head replacement mode (S101). In the present embodiment, if a reset button (not illustrated) is held down for a predetermined period (e.g., three seconds) or longer, the control unit of the inkjet recording apparatus shifts the inkjet recording apparatus to the recording head replacement mode. A button for shifting the apparatus to the recording head replacement mode may be provided and the operator may shift the apparatus to the recording head replacement mode using this button. Alternatively, shift may be done using an interface provided by a printer driver.

When the apparatus is shifted to the recording head replacement mode, recording head preprocessing (S102 to S105) is started. In a first step, the inkjet recording apparatus stops a supply driving source (102) to stop an operation of supplying the air into the main tanks 610. In a second step, the apparatus opens the air pressure relief valve (S103) to release pressure applied to the air supply tubes, so that ink supply from the main tanks 610 to the recording head 100 is stopped. In the present embodiment, the tubes are opened to the atmosphere through a solenoid valve (not illustrated). The tubes may be opened through a cam driven by the supply driving source. Subsequently, the apparatus moves the carriage 710 to the cleaning unit and stops an operation of sucking inks in the ink supply tubes 630 and the recording head 100 (S104). This suction operation removes ink residual pressure in the ink supply tubes 630 and the recording head 100.

After the suction operation, the inkjet recording apparatus allows the shaft lifting member 14 illustrated in FIG. 1 to lift up the guide shaft 13, so that the carriage 710 is moved to a position where the distance between a sheet and the discharge ports 111 of the recording head 100 is long (S105). Such a lift-up operation lifts the recording head 100 to a higher level. Since the recording head 100 is previously moved away from the platen 31 facing the head, the possibility of contact between the platen 31 and the discharge ports 111 of the recording head 100 may be further reduced when the recording head 100 is removed and a new recording head is mounted. The lift-up operation also allows the joint needle unit 80 to move to a higher level. Since the inks in the ink passages (not illustrated) arranged in the joint needle unit 80 return into the ink supply tubes 630 due to the difference in hydraulic head, the inks do not tend to fall when the recording head 100 is removed.

After that, the apparatus moves the carriage 710 toward the left (non-reference side) inner side surface of the chassis 10 such that the carriage 710 abuts against this surface (S106). Specifically, when the carriage 710 moves, the left end 932 of the slider member 930 in the needle attachment/detachment lever 90 comes into contact with the non-reference-side switching member 12 provided for the chassis 10, so that the carriage 710 begins to move in the needle attachment/detachment lever 90 relative thereto. As illustrated in FIGS. 11 and 12, the carriage 710 continues moving in the direction B2 in FIG. 11, so that the carriage 710 stops such that the non-reference abutment face 716 of the carriage 710 abuts against the left inner side surface of the chassis 10. At this time, the slider member 930 stops moving in the direction C2 in FIG. 12 in the needle attachment/detachment lever 90 relative thereto and is in the second position. In other words, while the carriage 710 moves to the left terminal position along the moving direction, the slider member 930 comes into contact with a second fixed part (non-reference-side switching member 12) of the recording apparatus before the carriage 710 reaches the terminal position and then moves relative to the carriage 710 while being in contact with the second fixed part. When the carriage 710 reaches the terminal position, the lever engagement member 920 is placed in the vicinity of the withdrawal permitting portions 934.

In the present embodiment, the slider member 930 moves by about 4 mm for the period between the time when the left end 932 abuts against the non-reference-side switching member 12 and the time when the carriage 710 stops such that it abuts against the left inner side surface of the chassis 10. Accordingly, the slider member 930 slides by about 4 mm relative to the needle attachment/detachment lever 90 in the needle attachment/detachment lever 90.

Upon abutment of the carriage 710 against the chassis 10, the stop position of the carriage 710 can be determined using the linear encoder as described above (S107). The position of the carriage 710 which has correctly moved to a non-reference abutment position may be previously stored as a reference arrival position in the control substrate. If an actually detected position differs from the reference arrival position, the apparatus determines that the slider member has been incorrectly moved. Thus, the apparatus can determine a sliding error (S108).

As described above, the abutment of the carriage 710 on the non-reference side allows the slider member 930 to be in the second position (FIG. 12). Thus, the lever engagement member 920 can be withdrawn (S109). After that, the apparatus moves the carriage 710 to a head replacement position at substantially the middle of its moving range (S110). After the above-described operating steps, the operator can replace the recording head 100.

Details of Method of Replacing Head

Procedure of Head Removal

A method of replacing the recording head 100, performed by the operator, will be described below. FIGS. 14 to 16 are schematic perspective views of the carrier unit 70 in operating steps of the head replacement operation in the inkjet recording apparatus illustrated in FIG. 1. FIG. 14 schematically illustrates a state where the recording head 100 is mounted and fixed, the needle attachment/detachment lever 90 is closed, and the lever engagement member 920 is pulled down in the withdrawal position. The partial enlarged cross-sections of the lever engagement member 920 and surroundings are illustrated in FIG. 8. FIG. 15 schematically illustrates a state where the head set lever 750 is closed, the recording head 100 is mounted and fixed, and the needle attachment/detachment lever 90 is opened such that the joint needle unit 80 is separated from the recording head 100. FIG. 16 schematically illustrates a state where both of the head set lever 750 and the needle attachment/detachment lever 90 are opened, the recording head 100 is removed, and the joint needle unit 80 is positioned far away from the recording head 100.

The method of removing the recording head 100 from the carriage 710, performed by the operator, will be described with reference to FIGS. 14 to 16. The needle attachment/detachment lever 90 is in the first rotation position where the joint needle unit 80 is connected to the recording head 100. The operator first pulls the lever engagement member 920, serving as the operating member for the needle attachment/detachment lever 90, toward the front of the apparatus. Consequently, the lever engagement member 920 is withdrawn downward and backward along the engagement-member guide faces 915 of the lever main body 910 as illustrated in FIGS. 14 and 8. Accordingly, the engagement portions 921 of the lever engagement member 920 are withdrawn from the hooks 718 of the carriage 710. Thus, the needle attachment/detachment lever 90 is rotatably released. When the operator further pulls the lever engagement member 920, the needle attachment/detachment lever 90 can be rotated such that the guide bosses 922 of the lever engagement member 920 serve as points of action on the engagement-member guide faces 915. In other words, the operator can rotate the needle attachment/detachment lever 90 in the direction D1 in FIG. 14.

When the needle attachment/detachment lever 90 is rotated, the outer circumferential cam faces 912 of the needle attachment/detachment lever 90 are pushed by the pushing guide members 722 of the carriage cover 720 while being slid thereon. Thus, the joint needle unit 80 translates in the direction G1 in FIG. 15. The needle pipes 811 are drawn from the sealing members 105 arranged on the ink supply ports 102 of the recording head 100, thus breaking the connection of the ink passages. The needle attachment/detachment lever 90 is therefore in the second rotation position where the joint needle unit 80 is disconnected from the recording head 100. A distance of sliding of the joint needle unit 80 is set such that the needle pipes 811 are spaced apart from the sealing member 105. The link connection portion 825 on each guiding side plate 820 is movable in the elongated connection hole 782 of the corresponding link member 780 while the joint needle unit 80 is sliding. Accordingly, if the needle attachment/detachment lever 90 is operated, a force making the head set lever 750 swing is not generated because the link connection portion 825 moves in the elongated connection hole 782, serving as the dead zone of the link member 780.

In the state illustrated in FIG. 15, the operator rotates the head set lever 750 about the lever rotation shaft 713 in the direction E1. The head set lever 750 has guide grooves 753 with which holder bosses (not illustrated) provided for the head fixing cams 744 are engaged, respectively. An operating force caused by rotation is transferred to the holder bosses. When a pushing force of head fixing springs acting through the head fixing cams 744 exceeds the operating force, fixing the recording head 100 by the head fixing member 740 is released. Each link member 780 rotates about the corresponding link connection portion 755 of the head set lever 750 in conjunction with the rotation of the head set lever 750, thus allowing the joint needle unit 80 connected through the link connection portions 825 to further translate in the direction Gl. At the completion of the rotation of the head set lever 750, the head fixing member 740 is opened in conjunction with the rotation as illustrated in FIG. 16. Sliding of the joint needle unit 80 in the direction G1 is also finished. In such a state, the needle pipes 811 of the joint needle unit 80 are positioned the farthest away from the recording head 100. Consequently, fixing the recording head 100 is released and the joint needle unit 80 is positioned the farthest away from the recording head 100. Accordingly, the operator can draw the recording head 100 obliquely upward from the carrier unit 70 and easily remove the recording head 100 from the inkjet recording apparatus.

Procedure of Head Mounting

An operation of mounting the recording head 100 onto the carriage 710, performed by the operator, will be described. This operation can be performed in reverse order to removing the recording head 100. In the state of FIG. 16, the operator first places the recording head 100 in the carrier unit 70 and then rotates the head set lever 750 about the lever rotation shaft 713 in the direction E2 in FIG. 16.

The head fixing member 740 swings about a shaft (not illustrated) of a head fixing cam holder 741 in conjunction with closing the head set lever 750, so that the head fixing member 740 is closed. At this time, the head fixing cams 744 provided for the head fixing member 740 come into contact with the recording head 100. The recording head 100 is pressed against the carriage 710 by the head fixing springs (not illustrated) through the head fixing cams 744 such that the recording head 100 is positioned and fixed.

Simultaneously, the link members 780 move in conjunction with swing of the head set lever 750. When the elongated connection hole 782 of each link member 780 moves in contact with the corresponding link connection portion 825, the joint needle unit 80 moves linearly in the direction G2. The joint needle unit 80 is guided while being regulated by the joint needle guides provided for the carriage cover 720, so that the joint needle unit 80 moves close to the recording head 100 in the direction G2 by a large amount. Thus, the needle pipes 811 move near the sealing members 105 of the recording head 100.

In the state where the recording head 100 is mounted and fixed as illustrated in FIG. 15, the operator rotates the needle attachment/detachment lever 90 in the direction D2 in FIG. 5. The inner circumferential cam faces 913 of the needle attachment/detachment lever 90 are drawn while acting on the retracting guide members 723 on the carriage cover 720, so that the joint needle unit 80 translates (slides) in the direction G2.

While the joint needle unit 80 is sliding, the link connection portion 825 on each guiding side plate 820 moves within the elongated connection hole 782, serving as a dead zone, of the corresponding link member 780. When the needle attachment/detachment lever 90 is operated, therefore, the head set lever 750 is not swung through the link members 780.

When the joint needle unit 80 is operated and the joint needle unit 80 moves toward the recording head 100, the positioning pins 813 of the joint needle unit 80 are inserted into the positioning cylinders 106 of the recording head 100, respectively, thus directly positioning the joint needle unit 80. Translation of the joint needle unit 80 in conjunction with operating the needle attachment/detachment lever 90 allows the needle pipes 811 to be inserted into the ink supply ports 102 of the recording head 100. The needle pipes 811 are inserted into the respective ink supply ports 102 while spreading small holes of the sealing members 105. The contact between the outer surface of each needle pipe 811 and the inner surface of the corresponding small hole ensures the ink sealing performance. Since the joint needle unit 80 is directly positioned with respect to the recording head 100 and the needle pipes 811 are then inserted into the respective ink supply ports 102 as described above, the passages can be stably and reliably provided.

At the completion of rotation of the needle attachment/detachment lever 90, the needle attachment/detachment lever 90 is returned to the first rotation position and the engagement portions 921 of the lever engagement member 920 of the needle attachment/detachment lever 90 engage with the hooks 718 of the carriage 710. Even while the carrier unit 70 is scanning, therefore, the posture of the needle attachment/detachment lever 90 is held. The needle attachment/detachment lever 90 is not released accidentally.

As described above, the operator sequentially rotates the head set lever 750 and the needle attachment/detachment lever 90, so that the operator can complete positioning and fixing the recording head 100 and connecting the joint needle unit 80 to the recording head 100 (see FIGS. 3 and 7).

Ink Filling Operation

Figure 17:
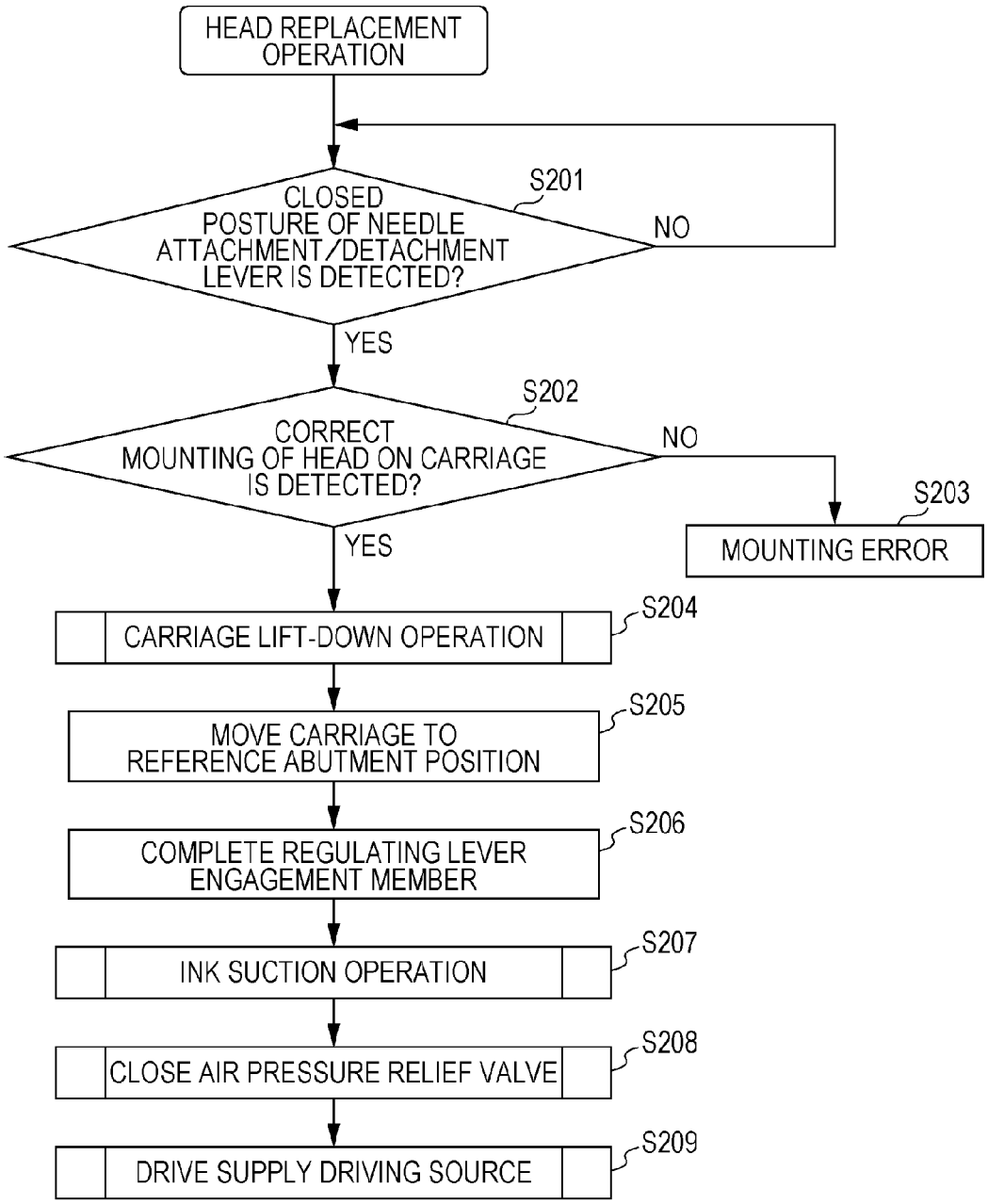
FIG. 17 is a flowchart of replacement post-processing in the recording head replacement mode.

An ink filling mode following the above-described series of operating steps of head mounting will be described. FIG. 17 is a general flowchart of head replacement postprocessing.

When the operator closes the needle attachment/detachment lever 90 as described above, the engagement between the lever engagement member 920 and the carriage 710 is detected on the basis of the shielding portion 924 of the lever engagement member 920 (S201). Since the needle attachment/detachment lever 90 is opened until shielding the photo-interrupter 734 by the shielding portion 924 is detected, the inkjet recording apparatus is on standby in such a state.

When the closed posture of the needle attachment/detachment lever 90 is detected, the inkjet recording apparatus determines whether the recording head 100 is correctly mounted on the carriage 710 (S202). Specifically, when detecting electrical connection between the head substrate provided for the recording head 100 and the pressure contact connector 732 provided for the carriage 710, the inkjet recording apparatus determines correct mounting.

When the inkjet recording apparatus recognizes, on the basis of the above-described series of operating steps, that the needle attachment/detachment lever 90 is closed and the recording head 100 is mounted on the carriage 710, the apparatus determines that mounting the recording head 100 by the operator has completed. The inkjet recording apparatus then proceeds to the next step of the recording head replacement postprocessing. If the apparatus determines that the recording head 100 is not mounted, the apparatus determines a mounting error (S203). In this case, for example, an LED blinks to notify the operator of the error and prompt the operator to mount the recording head. If the inkjet recording apparatus determines correct mounting of the recording head, the apparatus allows the shaft lifting member 14 to lift down the guide shaft 13 such that the guide shaft 13 is shifted to a position where the distance between a sheet and the discharge ports 111 of the recording head 100 is normal (S204).

In the next step, the apparatus moves the carriage 710 from the head replacement position such that the carriage abuts against the right (reference side) inner side surface of the chassis 10 (S205), thus confirming an initial position in the main scanning direction. Specifically, when the carriage 710 moves in the direction B1 in FIG. 9, the left end 932 of the slider member 930 provided in the needle attachment/detachment lever 90 comes into contact with the reference-side switching member 11. In such a state, the slider member 930 begins to move relative to the needle attachment/detachment lever 90 in the direction C1 in FIG. 10 in the needle attachment/detachment lever 90.

The carriage 710 further moves, so that the abutment reference face 715 of the carriage 710 abuts against the right inner side surface of the chassis 10. Thus, the carriage 710 stops. The slider member 930 moves by about 4 mm for the period between the time when the right end 931 of the slider member 930 abuts against the reference-side switching member 11 and the time when the carriage 710 stops. Accordingly, the slider member 930 slides relative to the needle attachment/detachment lever 90 by about 4 mm in the needle attachment/detachment lever 90.

After the above-described abutment of the carriage 710 on the reference side, the slider member 930 is in the first position (FIG. 10) and regulating withdrawal of the lever engagement member 920 is completed (S206). Specifically, while the carriage 710 moves to the right terminal position in the moving direction, the slider member 930 comes into contact with a first fixed part (reference-side switching member 11) of the recording apparatus before the carriage 710 reaches the terminal position. The slider member 930 moves relative to the carriage 710 while being in contact with the first fixed part. When the carriage 710 reaches the terminal position, the engagement-member rear end portions 923 of the lever engagement member 920 are positioned in the vicinity of the protrusions 933. The position of the carriage 710 which has correctly moved to the reference abutment position may be previously stored as a reference arrival position in the control substrate in a manner similar to the head replacement preprocessing. The occurrence of an error may be determined on the basis of the comparison between the reference arrival position and a detected abutment position of the carriage 710.

After the abutment on the reference side, postprocessing (S207 to S209) of recording head replacement is performed. Specifically, the apparatus moves the carriage 710 to the cleaning unit and inks in the ink supply tubes 630 and the recording head 100 are sucked by the cleaning unit (S207). This suction operation increases negative pressure in the ink supply tubes 630 and the recording head 100. After the suction operation, the apparatus closes the air pressure relief valve (S208) to hermetically seal an air supply path. After that, the apparatus drives the supply driving source (S209) to start an operation of supplying the air into the main tanks 610, thus supplying the inks from the main tanks 610 to the recording head 100. To stabilize a recording operation, the recording head 100 may be cleaned after the above-described series of operating steps.

As described above, after both of closing the needle attachment/detachment lever 90 and mounting the recording head 100 are recognized, operating the lever engagement member 920 is regulated and releasing the needle attachment/detachment lever 90 is then regulated. Accordingly, the movement of the joint needle unit 80 operatively connected to the needle attachment/detachment lever 90 is also regulated, thus completing locking the joint mechanism itself. After the above-described series of operating steps, the recording head is filled with the inks. Head replacement can be performed with reliability.

In the inkjet recording apparatus according to the embodiment described with reference to FIGS. 1 to 17, the operator is prevented from accidentally removing the recording head. The recording head can be reliably replaced as necessary.

In the present embodiment, the inkjet recording apparatus includes the lever for fixing the recording head and the lever for connecting the joint mechanism to the recording head. The present invention is also applicable to an inkjet recording apparatus including a single lever which functions as both of the above-described levers. In other words, the present invention is similarly applicable to an inkjet recording apparatus designed such that fixing the recording head to the carrier unit and connecting the joint mechanism to the recording head are performed using a single lever. Similar advantages can also be achieved.

In the present embodiment, the ink supply method used by the ink supply unit includes feeding the air into the ink tanks to apply pressure to the ink storage bags for ink supply. The ink supply method is not limited and any other method can be similarly used. In other words, a method of directly pressurizing the ink passages to supply inks or a method of supplying inks using the difference in hydraulic head between the recording head and each ink tank may be similarly used. Similar advantages can be achieved.

In the present embodiment, one recording head is mounted on the carrier unit. The present invention can be freely embodied irrespective of the number of recording heads. The present invention is applicable to a color-recording inkjet recording apparatus including a plurality of recording heads using different color inks in addition to an inkjet recording apparatus including one or more recording heads. Alternatively, the present invention is applicable to a gradation-recording inkjet recording apparatus including a plurality of recording heads using inks having the same color and different color densities. The present invention is similarly applicable to an inkjet recording apparatus as the combination of the above-described types. Similar advantages can be achieved.

The present invention is also applicable to an inkjet recording apparatus including an inkjet head cartridge (recording head) including an electromechanical conversion member, such as a piezoelectric element. The present invention, however, brings desirable effects in an inkjet recording apparatus including an inkjet head cartridge (recording head) that discharges ink using thermal energy, because such a method can achieve high-density and high-definition recording (printing).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An inkjet recording apparatus comprising:

a carriage configured to mount a recording head and to move for recording;

an ink passage member configured to supply ink to the recording head;

a connecting member, mounted on the carriage, configured to move to a connecting position where the ink passage member is connected to the recording head and to a disconnecting position where the ink passage member is not connected to the recording head;

an operating member configured to move the connecting member to the connecting position by moving to a first position and to move the connecting member to the disconnecting position by moving to a second position, and a regulating member, provided on the carriage, configured to move with respect to the carriage to switch between a first state, in which the operating member is permitted to move from the first position to the second position, and a second state in which the operating member is prevented from moving from the first position to the second position, the regulating member being moved by a movement of the carriage.

2. The apparatus according to claim 1, further comprising an ink tank configured to store ink to be supplied to the recording head, wherein the ink passage member comprises a tube configured to supply ink from the ink tank to the recording head.

3. The apparatus according to claim 1, wherein the recording head discharges ink for recording.

4. The apparatus according to claim 1, further comprising an ink supplying unit outside the carriage, the ink supplying unit being connected with the ink passage member.

5. The apparatus according to claim 1, wherein the operating member rotationally moves between the first position and the second position, and wherein the connecting member straightly moves between the connecting position and the disconnecting position.

6. The apparatus according to claim 5, wherein the operating member is engaged with the carriage by moving to the first position.

7. The apparatus according to claim 6, further comprising a detecting member configured to detect that the operating member is engaged with the carriage.

8. The apparatus according to claim 1, wherein a switching from the first state to the second state is performed when the regulating member moves in consequence of the movement of the carriage to one end of a moving range.

9. The apparatus according to claim 8, wherein a switching from the second state to the first state is performed when the regulating member moves in consequence of the movement of the carriage to the other end of the moving range.

10. The apparatus according to claim 1, further comprising a head fixing member configured to be capable of moving to a position where the recording head is fixed to the carriage and to a position where the recording head is able to be attached to and detached from the carriage.

11. The apparatus according to claim 10, wherein the head fixing member is not able to be operated in a case where the operating member is in the first position.

12. The apparatus according to claim 1, wherein the carriage translates along a guide shaft for recording.

13. The apparatus according to claim 12, wherein the carriage moves along the guide shaft, and the regulating member performs the switching between the first and second states by using the movement of the carriage.

14. The apparatus according to claim 1, wherein the operating member includes an engagement portion and the regulating member includes a protruding portion configured to engage with the engagement portion such that the operating member is prevented from moving from the first position to the second position.

15. The apparatus according to claim 14, wherein the regulating member includes a permitting portion which permits the operating member to move from the first position to the second position.

16. The apparatus according to claim 15, wherein the protruding and permitting portions move with respect to the engagement portion to switch between the first and second states.

* * * * *